US012702194B2

(12) United States Patent
Greenspan et al.

(10) Patent No.: US 12,702,194 B2
(45) Date of Patent: Aug. 11, 2026

(54) SOLE STRUCTURE FOR ARTICLE OF FOOTWEAR

(71) Applicant: NIKE, Inc., Beaverton, OR (US)

(72) Inventors: Joël Ryp Greenspan, Portland, OR (US); Oliver McLachlan, Beaverton, OR (US); Stuart Reinhardt, Beaverton, OR (US); Timothy J. Smith, Portland, OR (US); Krissy Yetman, Portland, OR (US)

(73) Assignee: NIKE, INC., Beaverton, OR (US)

( * ) Notice: Subject to any disclaimer, the term of this patent is extended or adjusted under 35 U.S.C. 154(b) by 0 days.

(21) Appl. No.: 18/958,853

(22) Filed: Nov. 25, 2024

(65) Prior Publication Data

US 2025/0082065 A1 Mar. 13, 2025

Related U.S. Application Data

(63) Continuation of application No. 16/999,839, filed on Aug. 21, 2020, now Pat. No. 12,185,789.
(Continued)

(51) Int. Cl.
*A43B 13/20* (2006.01)
*A43B 13/12* (2006.01)
*A43B 13/18* (2006.01)

(52) U.S. Cl.
CPC ..... *A43B 13/20* (2013.01); *A43B 13/127* (2013.01); *A43B 13/181* (2013.01); *A43B 13/186* (2013.01); *A43B 13/188* (2013.01)

(58) Field of Classification Search
CPC ..... A43B 13/20; A43B 13/127; A43B 13/181; A43B 13/186; A43B 13/188; A43B 13/223; A43B 13/183; A43B 5/02; A43C 13/04
See application file for complete search history.

(56) References Cited

U.S. PATENT DOCUMENTS 5,713,141 A 2/1998 Mitchell et al.
5,952,065 A 9/1999 Mitchell et al.
(Continued)

FOREIGN PATENT DOCUMENTS

CN 108968227 A 12/2018

OTHER PUBLICATIONS

Chinese Office Action, CN App. No. 202080071023.5, issued May 23, 2024. (6 pages).
(Continued)

*Primary Examiner* — Haley A Smith
(74) *Attorney, Agent, or Firm* — Bookoff McAndrews PLLC.

(57) ABSTRACT

A sole structure for an article of footwear includes a first plate extending from a forefoot region of the sole structure to a heel region of the sole structure. The first plate has a first surface and a second surface formed on an opposite side of the first plate than the first surface. The sole structure further includes a second plate extending from the forefoot region to the heel region. The second plate has a third surface opposing the second surface of the first plate and a fourth surface disposed on an opposite side of the second plate than the third surface. The third surface is spaced apart from the second surface to define a cavity between the first plate and the second plate that extends from a medial side of the sole structure to a lateral side of the sole structure between the forefoot region and the heel region.

19 Claims, 25 Drawing Sheets

Related U.S. Application Data

(60) Provisional application No. 62/891,082, filed on Aug. 23, 2019.

(56) References Cited

U.S. PATENT DOCUMENTS

| | | | | |
|---|---|---|---|---|
| 6,016,613 | A | 1/2000 | Campbell et al. | |
| 6,582,786 | B1 | 6/2003 | Bonk et al. | |
| 7,886,461 | B2 | 2/2011 | Sato | |
| 8,122,615 | B2 | 2/2012 | Lucas et al. | |
| 8,713,819 | B2 | 5/2014 | Auger et al. | |
| 9,572,398 | B2 | 2/2017 | Hurd et al. | |
| 10,182,613 | B2 | 1/2019 | Kim et al. | |
| 2002/0144430 | A1 | 10/2002 | Schmid | |
| 2004/0049946 | A1 | 3/2004 | Lucas et al. | |
| 2005/0155254 | A1* | 7/2005 | Smith | A43B 21/26 36/27 |
| 2005/0166422 | A1 | 8/2005 | Schaeffer et al. | |
| 2006/0137227 | A1 | 6/2006 | Kita et al. | |
| 2009/0241377 | A1 | 10/2009 | Kita et al. | |
| 2012/0174432 | A1 | 7/2012 | Peyton | |
| 2017/0071287 | A1 | 3/2017 | Kim et al. | |
| 2017/0280816 | A1 | 10/2017 | Lyden | |
| 2018/0213886 | A1* | 8/2018 | Connell | A43B 13/186 |
| 2018/0255871 | A1 | 9/2018 | Conway et al. | |
| 2019/0246738 | A1 | 8/2019 | Connell et al. | |
| 2021/0052034 | A1 | 2/2021 | Cass et al. | |

OTHER PUBLICATIONS

International Search Report and Written Opinion, PCT/US2020/047536, mailed Dec. 4, 2020. (12 pages).

* cited by examiner

SOLE STRUCTURE FOR ARTICLE OF FOOTWEAR

CROSS REFERENCE TO RELATED APPLICATIONS

This application is a continuation of and claims the benefit of priority to U.S. application Ser. No. 16/999,839, filed on Aug. 21, 2020, which claims priority to U.S. Provisional Application No. 62/891,082, filed on Aug. 23, 2019, the entireties of which are incorporated herein by reference.

FIELD

The present disclosure relates generally to articles of footwear, and more particularly to a sole structure for an article of footwear.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from polymers or other materials that impart durability and wear-resistance, as well as enhancing traction with the ground surface. Another layer of the sole structure includes a midsole disposed between the outsole and the upper. The midsole provides cushioning for the foot and is, generally, at least partially formed from a polymer foam material that compresses resiliently under an applied load to cushion the foot by attenuating ground-reaction forces. The midsole may define a bottom surface on one side that opposes the outsole and a footbed on the opposite side that may be contoured to conform to a profile of the bottom surface of the foot. Sole structures may also include a comfort-enhancing insole and/or a sockliner located within a void proximate to the bottom portion of the upper.

DESCRIPTION OF THE DRAWINGS

The drawings described herein are of selected embodiments for illustrative purposes only.

Accordingly, the drawings do not include all possible implementations, and are not intended to limit the scope of the present disclosure.

Corresponding reference numerals indicate corresponding parts throughout the several views of the drawings.

DETAILED DESCRIPTION

Figure 1:
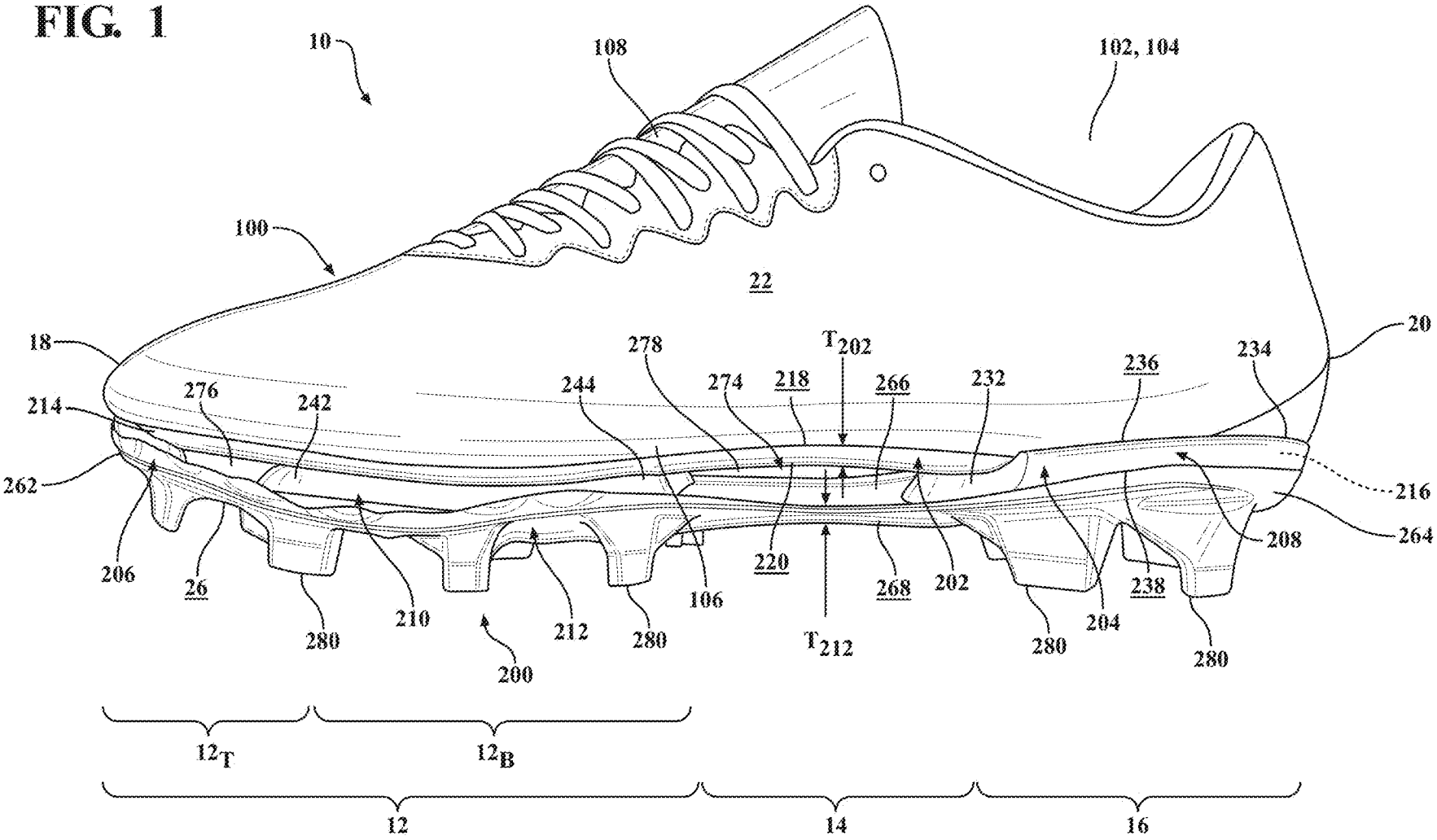
FIGS. 1-7 illustrate an example of an article of footwear including a sole structure in accordance with the principles of the present disclosure.

Example embodiments will now be described more fully with reference to the accompanying drawings. Example embodiments are provided so that this disclosure will be thorough, and will fully convey the scope of those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

One aspect of the disclosure includes a sole structure for an article of footwear including an upper. The sole structure includes a first plate extending from a forefoot region of the sole structure to a heel region of the sole structure. The first plate has a first surface opposing the upper and a second surface formed on an opposite side of the first plate than the first surface. The sole structure further includes a second plate extending from the forefoot region of the sole structure to the heel region of the sole structure. The second plate has a third surface opposing the second surface of the first plate and a fourth surface disposed on an opposite side of the second plate than the third surface. The third surface is spaced apart from the second surface to define a cavity between the first plate and the second plate that extends from a medial side of the sole structure to a lateral side of the sole structure between the forefoot region and the heel region.

Implementations of the disclosure may include one or more of the following optional features. In some examples, the sole structure includes a first cushion disposed between the first plate and the second plate in the forefoot region. Here, the first cushion is attached to the second surface of the first plate and is attached to the third surface of the second plate. Optionally, the first cushion is a fluid-filled bladder. In some implementations, the sole structure includes a second cushion disposed between the first plate and the second plate. Here, the second cushion is disposed between the first cushion and an anterior end of the sole structure. Optionally, the second cushion is disposed between the first cushion and a posterior end of the sole structure. In some aspects, the second cushion is formed from foam.

In some implementations, the fourth surface defines a ground-contacting surface of the sole structure. In some examples, the sole structure includes at least one traction element extending from the fourth surface.

Another aspect of the disclosure provides a sole structure for an article of footwear including an upper. The sole structure includes a first plate extending from a forefoot region of the sole structure to a heel region of the sole structure. The first plate includes a first surface opposing the upper and a second surface formed on an opposite side of the first plate than the first surface. The sole structure further includes a second plate extending from the forefoot region of the sole structure to the heel region of the sole structure. The second plate has a third surface opposing the second surface of the first plate and a fourth surface disposed on an opposite side of the second plate than the third surface. The third surface is spaced apart from the second surface to define a cavity between the first plate and the second plate. A first cushion is disposed between the first plate and the second plate in the heel region, and a second cushion is disposed between the first plate and the upper in the forefoot region. The second cushion is different than the first cushion.

Implementations of the disclosure may include one or more of the following optional features. In some examples, the first cushion is one of a fluid-filled bladder and a foam member and the second cushion is the other of the fluid-filled bladder and the foam member. In some implementations, the first cushion is attached to the second surface of the first plate and is attached to the third surface of the second plate. Here, the second cushion may be attached to the first surface of the first plate. In some implementations, the second cushion is attached to the first surface of the first plate.

In some configurations, the first cushion is spaced apart from the second cushion by a gap. Optionally, the gap extends through the sole structure from a medial side of the sole structure to a lateral side of the sole structure.

In some examples, at least one of the first cushion and the second cushion is visible at a medial side of the sole structure and at a lateral side of the sole structure. In some implementations, the fourth surface defines a ground-contacting surface of the sole structure. Optionally, the sole structure includes at least one traction element extending from the fourth surface.

Another aspect of the disclosure provides a sole structure for an article of footwear including an upper. The sole structure includes a first plate extending from a forefoot region of the sole structure to a heel region of the sole structure. The first plate includes a first surface opposing the upper and a second surface formed on an opposite side of the first plate than the first surface. The sole structure further includes a second plate extending from the forefoot region of the sole structure to the heel region of the sole structure. The second plate has a third surface opposing the second surface of the first plate and a fourth surface disposed on an opposite side of the second plate than the third surface. An elongate first fluid-filled bladder is disposed between the first plate and the second plate and an elongate second fluid-filled bladder is disposed between the first plate and the second plate.

Implementations of the disclosure may include one or more of the following optional features. In some examples, the elongate first fluid-filled bladder is fluidly isolated from the elongate second fluid-filled bladder. In some implementations, the elongate first fluid-filled bladder and the elongate second fluid-filled bladder are attached to the second surface of the first plate and to the third surface of the second plate. In some configurations, the elongate first fluid-filled bladder is spaced apart from the elongate second fluid-filled bladder in a direction extending between a medial side of the sole structure and a lateral side of the sole structure.

In some examples, at least one of the elongate first fluid-filled bladder and the elongate second fluid-filled bladder includes a tensile member disposed therein. Optionally, at least one of the elongate first fluid-filled bladder and the elongate second fluid-filled bladder is pressurized. In some implementations, the elongate first fluid-filled bladder and the elongate second fluid-filled bladder are disposed in a forefoot region of the sole structure. In some configurations, at least one of the elongate first fluid-filled bladder and the elongate second fluid-filled bladder is visible at a medial side of the sole structure and at a lateral side of the sole structure.

In some examples, the fourth surface defines a ground-contacting surface of the sole structure. Optionally, the sole structure includes at least one traction element extending from the fourth surface. In some implementations, the second plate includes a plurality of traction elements.

Referring to FIGS. 1-7, an article of footwear 10 includes an upper 100 and sole structure 200. The article of footwear 10 may be divided into one or more regions. The regions may include a forefoot region 12, a mid-foot region 14, and a heel region 16. The forefoot region 12 may be subdivided into a toe portion $\mathbf{12}_T$ corresponding with phalanges, and a ball portion $\mathbf{12}_B$ associated with metatarsal bones of a foot. The mid-foot region 14 may correspond with an arch area of the foot, and the heel region 16 may correspond with rear portions of the foot, including a calcaneus bone. The footwear 10 may further include an anterior end 18 associated with a forward-most point of the forefoot region 12 and a posterior end 20 associated with a rearward-most point of the heel region 16. A longitudinal axis of the footwear 10 extends along a length of the footwear 10 from the anterior end 18 to the posterior end 20, and generally divides the footwear 10 into a medial side 22 and a lateral side 24. Accordingly, the medial side 22 and the lateral side 24 respectively correspond with opposite sides of the footwear 10 and extend through the regions 12, 14, 16.

The upper 100 includes interior surfaces that define an interior void 102 configured to receive and secure a foot for support on the sole structure 200. The upper 100 may be formed from one or more materials that are stitched or adhesively bonded together to form the interior void 102. Suitable materials of the upper 100 may include, but are not limited to, mesh, textiles, foam, leather, and synthetic leather. The materials may be selected and located to impart properties of durability, air-permeability, wear-resistance, flexibility, and comfort. An ankle opening 104 in the heel region 16 may provide access to the interior void 102. For example, the ankle opening 104 may receive a foot to secure the foot within the void 102 and to facilitate entry and removal of the foot to and from the interior void 102.

In some examples the upper 100 includes a strobel 106 having a bottom surface opposing the sole structure 200 and an opposing top surface defining a footbed of the interior void 102. Stitching or adhesives may secure the strobel to the upper 100. The footbed may be contoured to conform to a profile of the bottom surface (e.g., plantar) of the foot. Optionally, the upper 100 may also incorporate additional layers such as an insole or sockliner that may be disposed upon the strobel 106 and reside within the interior void 102 of the upper 100 to receive a plantar surface of the foot to enhance the comfort of the article of footwear 10.

In some examples, one or more fasteners 108 extend along the upper 100 to adjust a fit of the interior void 102 around the foot and to accommodate entry and removal of the foot therefrom. The upper 100 may include apertures such as eyelets and/or other engagement features such as fabric or mesh loops that receive the fasteners 108. The fasteners 108 may include laces, straps, cords, hook-and-loop, or any other suitable type of fastener. The upper 100 may include a tongue portion that extends between the interior void 102 and the fasteners 108. Additionally or alternatively, the upper 100 may be formed with a tensioning system including a series of cables routed through cable locking devices attached to the article of footwear.

With reference to FIG. 1, the sole structure 200 includes a chassis plate 202 extending between the medial side 22 and the lateral side 24 from the anterior end 18 to the posterior end 20. The sole structure 200 further includes a midsole 204 attached to the chassis plate 202 and including a forefoot pad 206 disposed adjacent the anterior end 18 of the chassis plate 202, a heel pad 208 disposed adjacent the posterior end 20 of the chassis plate 202, and a cushion 210 disposed adjacent to the forefoot pad 206 in the forefoot region 12 of the chassis plate 202. The sole structure 200 further includes an outsole plate 212 attached to each of the forefoot pad 206, the heel pad 208, and the cushion 210 to define a ground-engaging surface 26 of the article of footwear 10.

With reference to FIG. 1, the chassis plate 202 extends continuously from a first end 214 at the anterior end 18 of the sole structure 200 to a second end 216 at the posterior end 20, and spans a width of the sole structure 200 from the medial side 22 to the lateral side 24. The chassis plate 202 further includes an upper surface 218 facing the bottom of the upper 100, and a lower surface 220 formed on an opposite side of the chassis plate 202 from the upper surface 218. A distance from the upper surface 218 to the lower surface 220 defines a thickness $T_{202}$ of the chassis plate 202. In the illustrated example, the upper surface 218 of the chassis plate 202 is positioned against the strobel 106 of the upper 100 from the anterior end 18 to the posterior end 20. In some examples, the entire upper surface 218 is attached to the strobel 106 of the upper 100, such that the upper surface 218 of the chassis plate 202 defines a profile of the footbed.

The chassis plate 202 is formed of a material providing relatively high strength and stiffness, such as polymeric material and/or composite materials. In some examples, the chassis plate 202 is a composite material manufactured using fiber sheets or textiles, including pre-impregnated (i.e., "prepreg") fiber sheets or textiles. Alternatively or additionally, the chassis plate 202 may be manufactured by strands formed from multiple filaments of one or more types of fiber (e.g., fiber tows) by affixing the fiber tows to a substrate or to each other to produce a plate having the strands of fibers arranged predominately at predetermined angles or in predetermined positions. When using strands of fibers, the types of fibers included in the strand can include synthetic polymer fibers which can be melted and re-solidified to consolidate the other fibers present in the strand and, optionally, other components such as stitching thread or a substrate or both. Alternatively or additionally, the fibers of the strand and, optionally the other components such as stitching thread or a substrate or both, can be consolidated by applying a resin after affixing the strands of fibers to the substrate and/or to each other.

In some configurations, chassis plate 202 may be formed from one or more layers of tows of fibers and/or layers of fibers including at least one of carbon fibers, boron fibers, glass fibers, and polymeric fibers. In a particular configuration, the fibers include carbon fibers, or glass fibers, or a combination of both carbon fibers and glass fibers. The tows of fibers may be affixed to a substrate. The tows of fibers may be affixed by stitching or using an adhesive. Additionally or alternatively, the tows of fibers and/or layers of fibers may be consolidated with a thermoset polymer and/or a thermoplastic polymer. Accordingly, the chassis plate 202 may have a tensile strength or flexural strength in a transverse direction substantially perpendicular to the longitudinal axis of the article of footwear (i.e., the axis extending from the anterior end 18 to the posterior end 20). The stiffness of the chassis plate 202 may be selected for a particular wearer based on the wearer's tendon flexibility, calf muscle strength, and/or metatarsophalangeal (MTP) joint flexibility. Moreover, the stiffness of the chassis plate 202 may also be tailored based upon a running motion of the athlete. In other configurations, the chassis plate 202 is formed from one or more layers/plies of unidirectional tape. In some examples, each layer in the stack includes a different orientation than the layer disposed underneath. The plate may be formed from unidirectional tape including at least one of carbon fibers, boron fibers, glass fibers, and polymeric fibers. In some examples, the one or more materials forming the chassis plate 202 result in the chassis plate 202 having a Young's modulus of at least 70 gigapascals (GPa).

In some implementations, the chassis plate 202 includes a substantially uniform thickness $T_{202}$. In some examples, the thickness $T_{202}$ of the chassis plate 202 ranges from about 0.6 millimeters (mm) to about 3.0 mm. In one example, the thickness $T_{202}$ of the chassis plate 202 is substantially equal to one 1.0 mm. In other implementations, the thickness $T_{202}$ of the chassis plate 202 is non-uniform such that the chassis plate 202 may have a greater thickness $T_{202}$ in one region 12, 14, 16 the sole structure 200 than the thicknesses $T_{202}$ in the other regions 12, 14, 16.

Referring still to FIG. 1, the midsole 204 is disposed between the chassis plate 202 and the outsole plate 212, and is configured to attenuate forces associated with impact of the sole structure 200 with a ground surface. As identified in FIG. 2, the midsole 204 includes the forefoot pad 206, the heel pad 208, and the cushion 210.

Figure 3:
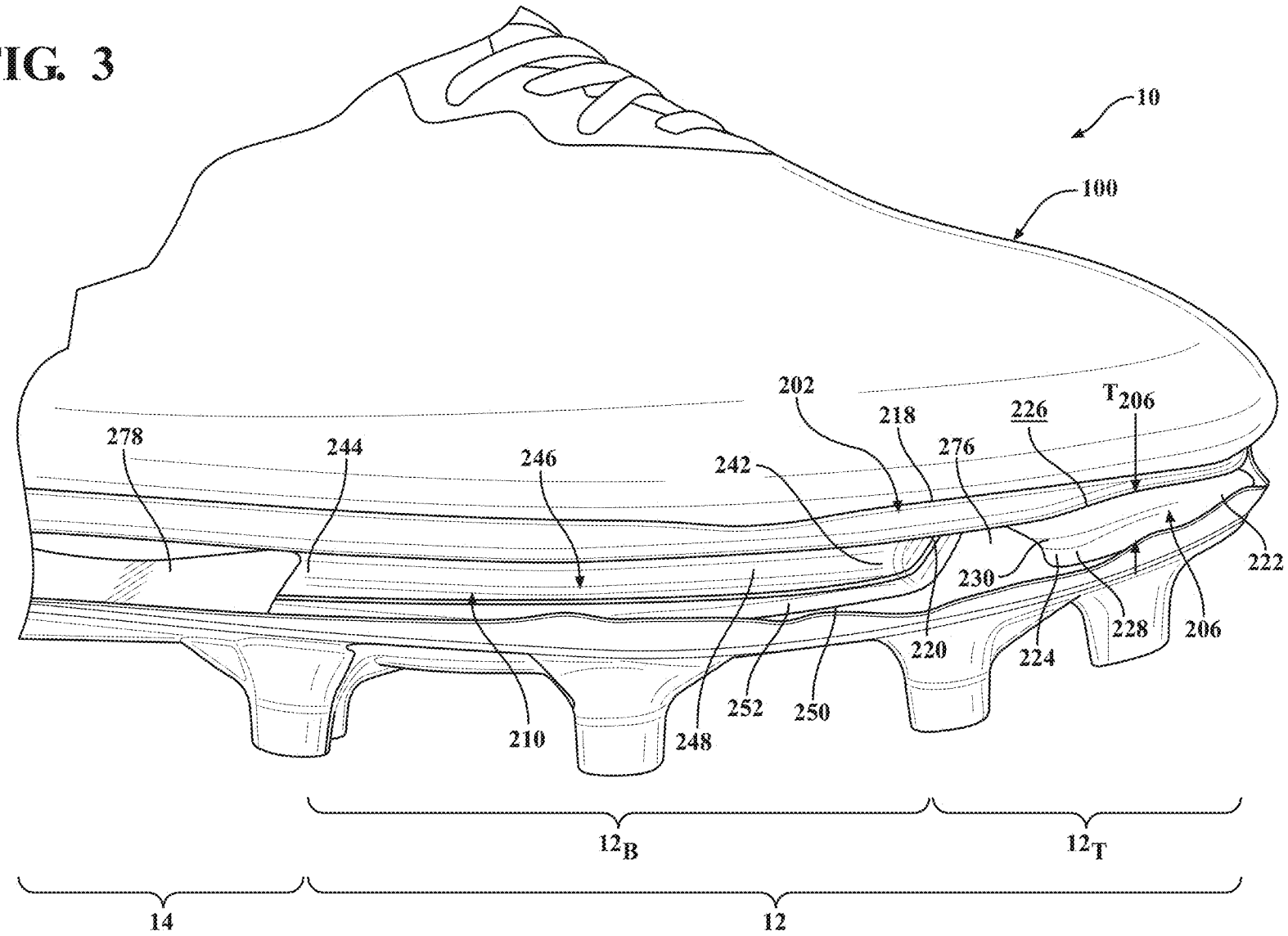
Figure 4:
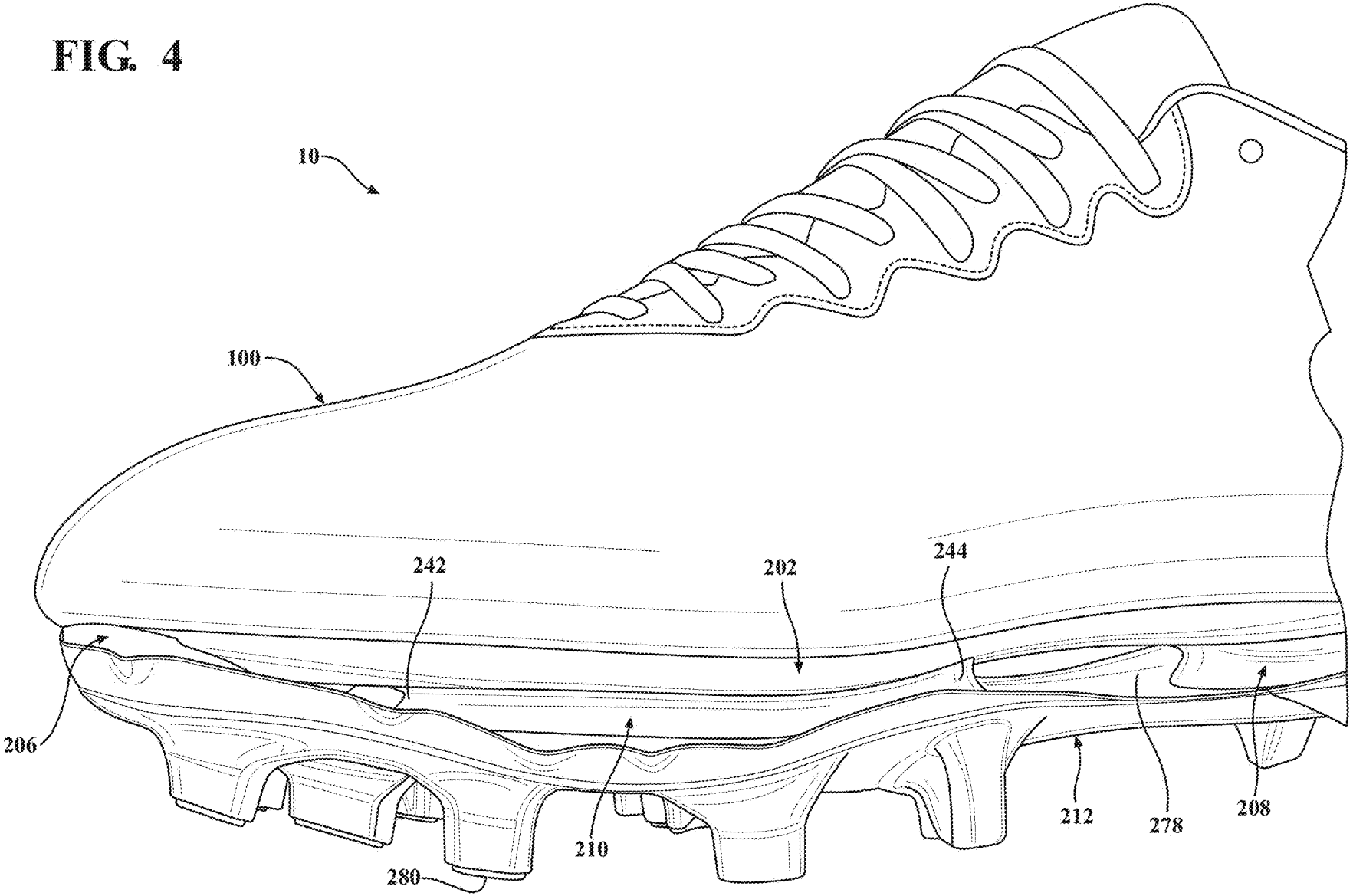

As best shown in FIG. 4, the forefoot pad 206 extends from a first end 222 at the anterior end 18 of the sole structure 200 to a second end 224 within the forefoot region 12. In the illustrated embodiment, the forefoot pad 206 is disposed within the toe portion $\mathbf{12}_T$ of the forefoot region 12. An upper surface 226 of the forefoot pad 206 is attached to the lower surface 220 of the chassis plate 202. The forefoot pad 206 further includes a lower surface 228 formed opposite the upper surface 226, and a peripheral side surface 230 extending between the lower surface 228 and the upper surface 226. A distance between the upper surface 226 and the lower surface 228 defines a thickness $T_{206}$ of the forefoot pad 206. As shown in FIG. 3, the upper surface 226 and the lower surface 228 diverge from each other in a direction from the first end 222 to the second end 224. Accordingly, the thickness $T_{206}$ of the forefoot pad 206 increases continuously from the first end 222 to the second end 224, such that the forefoot pad forms a wedge between the chassis plate 202 and the outsole plate 212 in the toe portion $\mathbf{12}_T$. The second end 224 of the forefoot pad 206 may be contoured, and extend along an arcuate or concave path between the medial side 22 and the lateral side 24.

Figure 5:
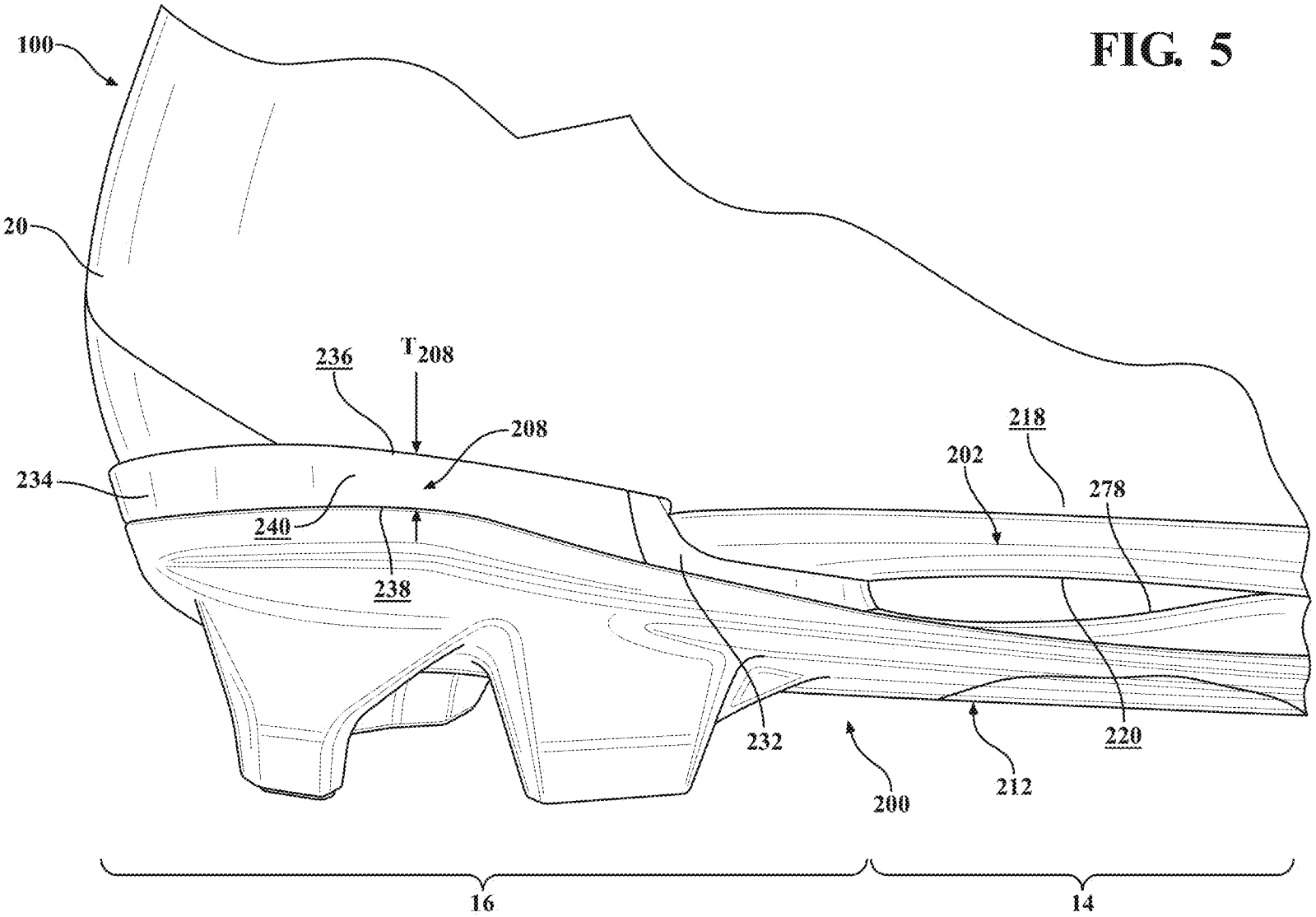
Figure 6:
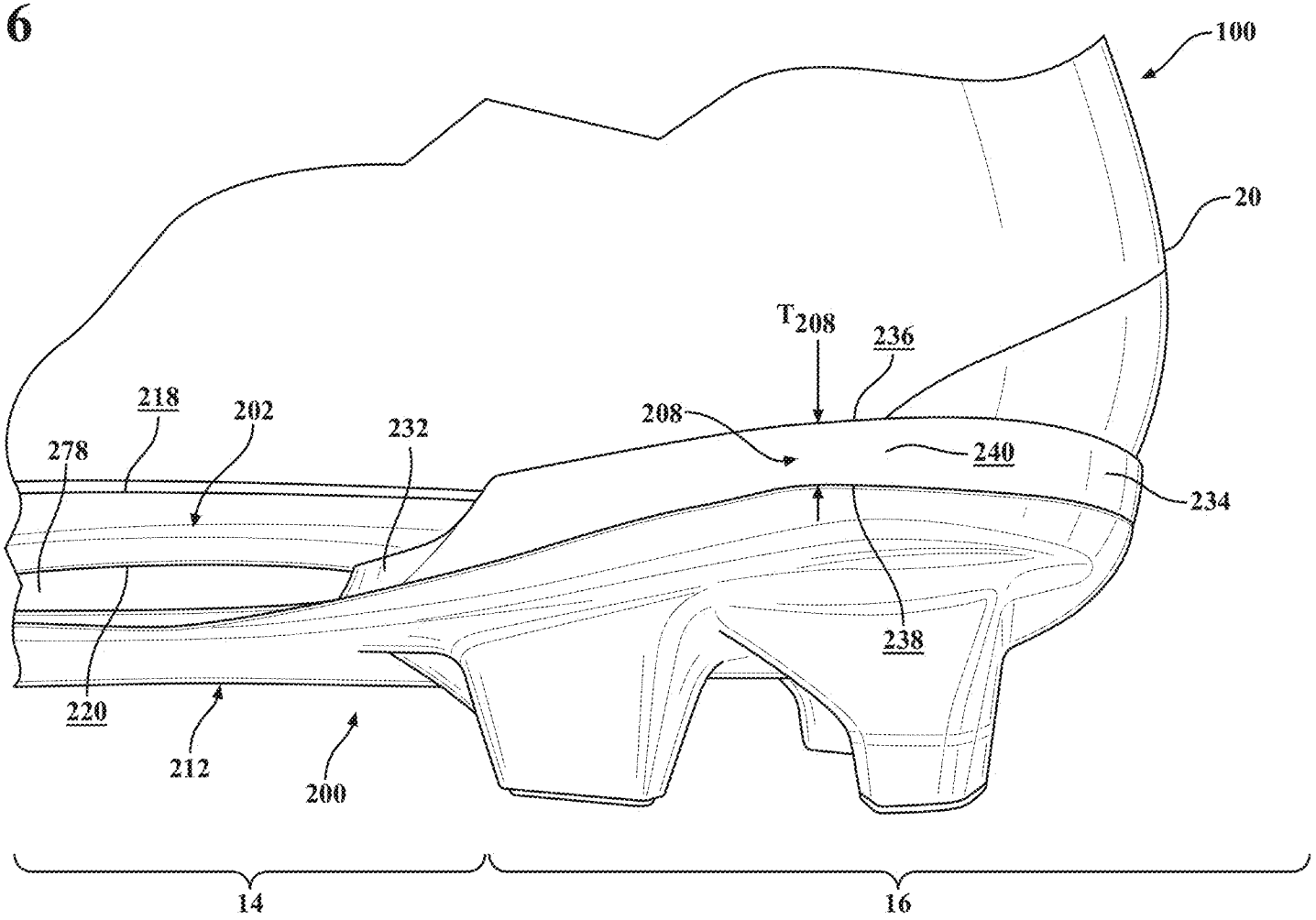
Figure 7:
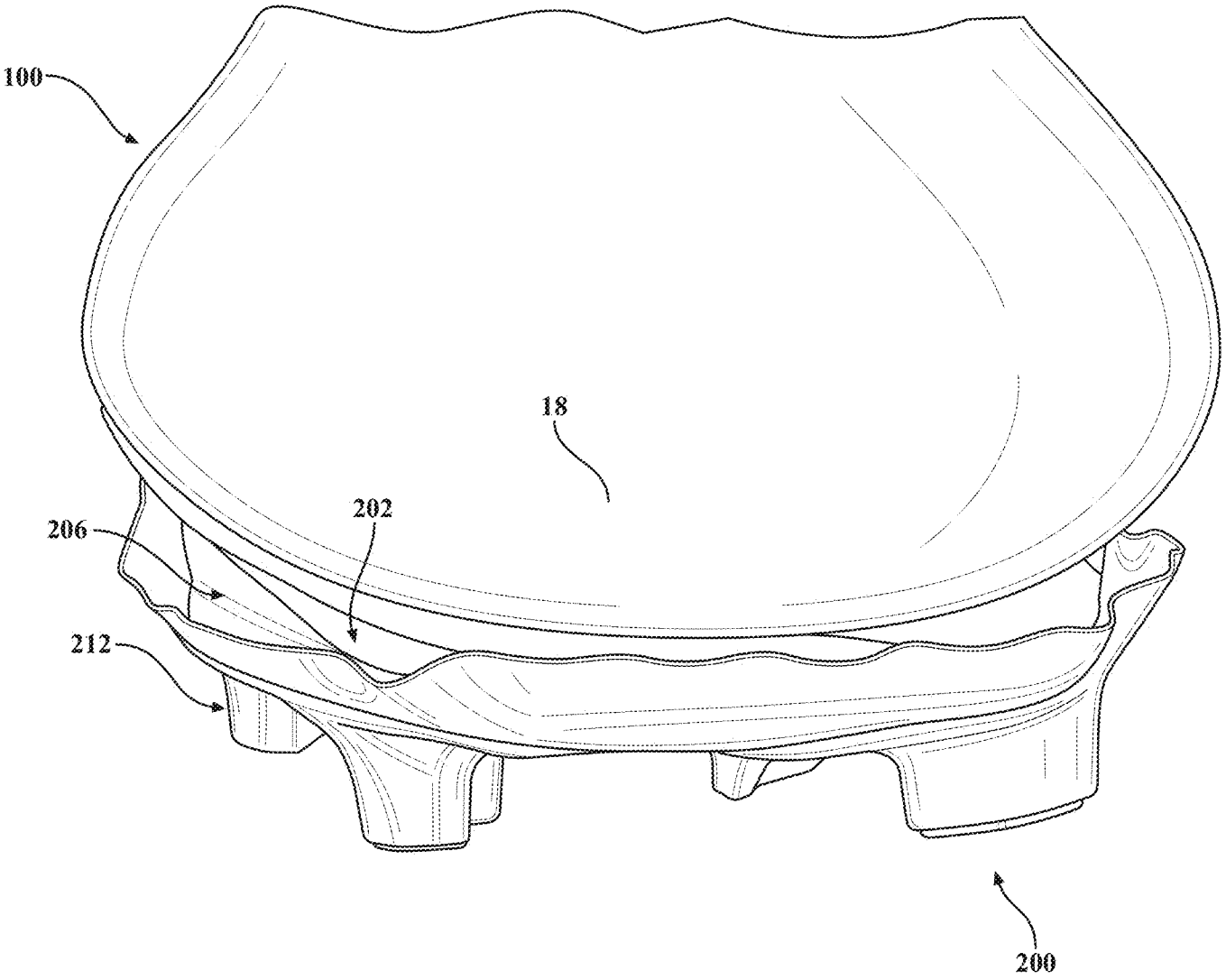

Referring to FIGS. 5 and 6, the heel pad 208 is attached to the lower surface 220 of the chassis plate 202 and extends from a first end 232 adjacent to the mid-foot region 14 to a second end 234 at the posterior end 20 of the sole structure 200. The heel pad 208 includes an upper surface 236 attached to the lower surface 220 of the chassis plate 202, and a lower surface 238 formed opposite the upper surface 236. The heel pad 208 further includes a peripheral side surface 240 extending between the upper surface 236 and the lower surface 238. In some examples, the upper surface 236 may be concave and curve upwardly towards the peripheral side surface 240 to define a heel cup around the anterior end 18 of the upper 100.

Each of the forefoot pad 206 and the heel pad 208 may be at least partially formed of a resilient polymeric material, such as foam or rubber, to impart properties of cushioning, responsiveness, and energy distribution to the foot of the wearer. Example resilient polymeric materials for the pads 206, 208 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., cross-linked polyurethanes and/or thermoplastic polyurethanes). Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as adodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a cross-linking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

Figure 2:
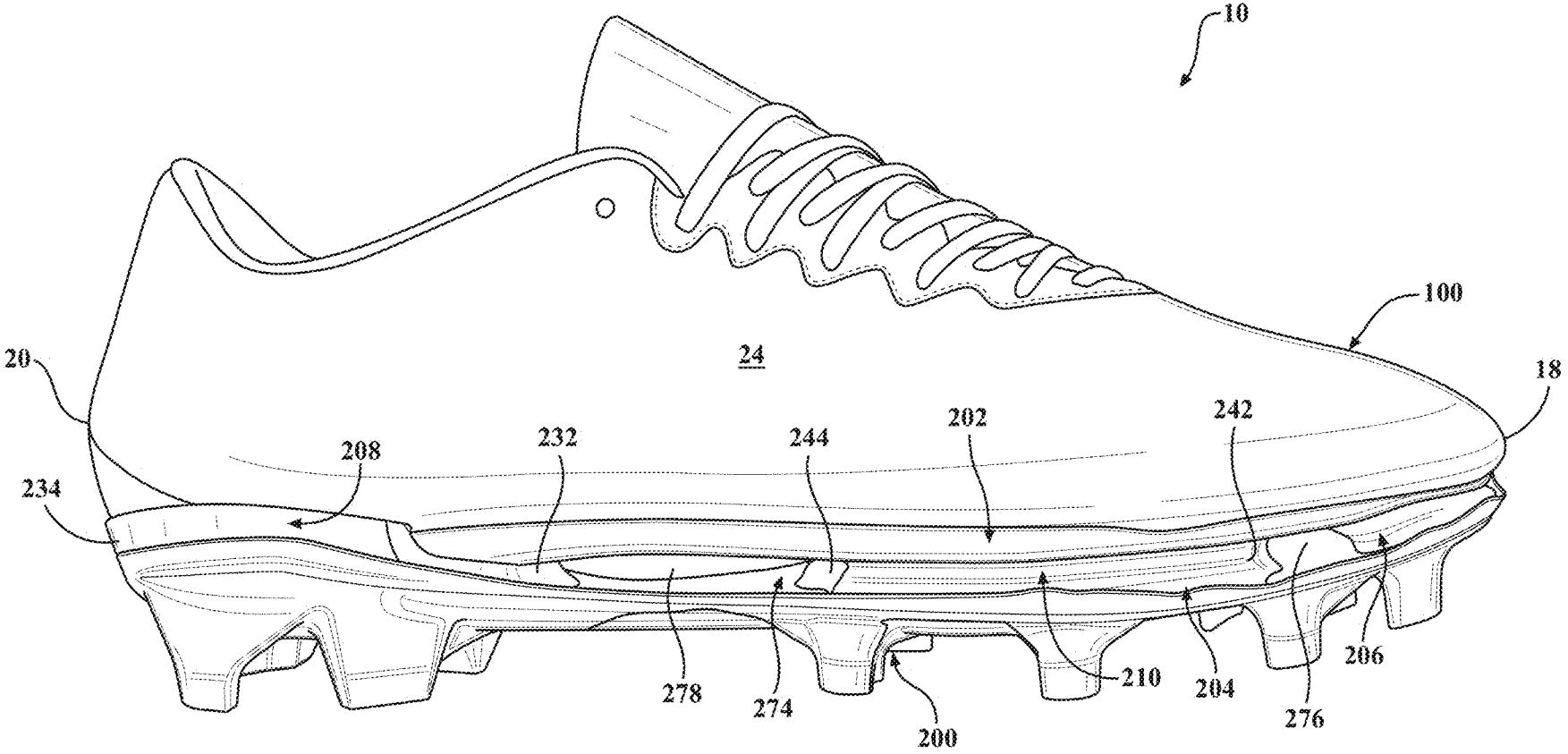

With continued reference to FIGS. 1 and 2, the cushion 210 is interposed between the chassis plate 202 and the outsole plate 212. The cushion 210 is attached to the chassis plate 202 between the forefoot pad 206 and the heel pad 208, and extends from a first end 242 in the forefoot region 12 to a second end 244 in mid-foot region 14. The first end 242 of the cushion 210 faces and is spaced apart from the second end 224 of the forefoot pad 206, as shown in FIGS. 1-3. In one configuration, the cushion 210 extends continuously from the medial side 22 to the lateral side 24 of the sole structure 200. For example, the cushion 210 may extend from a peripheral edge of the outsole plate 212 at the medial side 22 to a peripheral edge of the outsole plate 212 at the lateral side 24.

With reference to FIGS. 3 and 4, the cushion 210 of the illustrated example is a fluid-filled bladder 210 defining a chamber 246 for including a pressurized fluid. The cushion 210 may include a first, upper barrier layer 248 and a second, lower barrier layer 250. The upper barrier layer 248 may be attached to the lower barrier layer 250 by applying heat and pressure at a perimeter of the upper barrier layer 248 and the lower barrier layer 250 to define a peripheral seam 252. The peripheral seam 252 seals the chamber 246 and defines the peripheral profile of the cushion 210.

As used herein, the term "barrier layer" (e.g., barrier layers 248, 250) encompasses both monolayer and multilayer films. In some embodiments, one or both of barrier layers 248, 250 are each produced (e.g., thermoformed or blow molded) from a monolayer film (a single layer). In other embodiments, one or both of barrier layers 248, 250 are each produced (e.g., thermoformed or blow molded) from a multilayer film (multiple sublayers). In either aspect, each layer or sublayer can have a film thickness ranging from about 0.2 micrometers to about be about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of barrier layers 248, 250 can independently be transparent, translucent, and/or opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 248, 250 can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4, 4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier layers 248, 250 may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entirety. In embodiments where the barrier layers 248, 250 include two or more sublayers, examples of suitable multilayer films include microlayer films, such as those disclosed in Bonk et al., U.S. Pat. No. 6,582,786, which is incorporated by reference in its entirety. In further embodiments, the barrier layers 248, 250 may each independently include alternating sublayers of one or more TPU copolymer materials and one or more EVOH copolymer materials, where the total number of sublayers in each of the barrier layers 248, 250 includes at least four (4) sublayers, at least ten (10) sublayers, at least twenty (20) sublayers, at least forty (40) sublayers, and/or at least sixty (60) sublayers.

The fluid-filled chamber 246 can be produced from the barrier layers 248, 250 using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 248, 250 can be produced by co-extrusion followed by vacuum thermoforming to produce an inflatable chamber 246, which can optionally include one or more valves (e.g., one way valves) that allows chamber 246 to be filled with the fluid (e.g., gas).

The chamber 246 can be provided in a fluid-filled (e.g., as provided in footwear 10) or in an unfilled state. The chamber 246 can be filled to include any suitable fluid, such as a gas or liquid. In an aspect, the gas can include air, nitrogen ($N_2$), or any other suitable gas. In other aspects, the chamber 246 can alternatively include other media, such as pellets, beads, ground recycled material, and the like (e.g., foamed beads and/or rubber beads). The fluid provided to the chamber 246 can result in the chamber 246 being pressurized. In some examples, the chamber 246 is at a pressure ranging from 15 psi (pounds per square inch) to 25 psi. In other examples, the chamber 246 may have a pressure ranging from 20 psi to 25 psi. In some examples, the chamber 246 has a pressure of 20 psi. In other examples, the chamber 246 has a pressure of 25 psi. Alternatively, the fluid provided to the chamber 246 can be at atmospheric pressure such that the chamber 246 is not pressurized but, rather, simply contains a volume of fluid at atmospheric pressure.

The fluid-filled chamber 246 desirably has a low gas transmission rate to preserve its retained gas pressure. In some embodiments, fluid-filled chamber 246 has a gas transmission rate for nitrogen gas that is at least about ten (10) times lower than a nitrogen gas transmission rate for a butyl rubber layer of substantially the same dimensions. In an aspect, fluid-filled chamber 246 has a nitrogen gas transmission rate of 15 cubic-centimeter/square-meter·atmosphere·day ($cm^3/m^2$·atm·day) or less for an average film thickness of 500 micrometers (based on thicknesses of barrier layers 248, 250). In further aspects, the transmission rate is 10 $cm^3/m^2$·atm·day or less, 5 $cm^3/m^2$·atm·day or less, or 1 $cm^3/m^2$·atm·day or less.

The chamber 246 of the cushion 210 may receive a tensile element (not visible) therein. Each tensile element may include a series of tensile strands extending between an upper tensile sheet and a lower tensile sheet. The upper tensile sheet may be attached to the upper barrier layer 248 while the lower tensile sheet may be attached to the lower barrier layer 250. In this manner, when the chamber 246 receives the pressurized fluid, the tensile strands of the tensile element are placed in tension. Because the upper tensile sheet is attached to the upper barrier layer 248 and the lower tensile sheet is attached to the lower barrier layer 250, the tensile strands retain a desired shape of the cushion 210 when the pressurized fluid is injected into the chamber.

While the cushion 210 is described and shown as including a continuous fluid-filled chamber 246, the cushion 210 could alternatively include other configurations. For example, the cushion 210 may include a plurality of fluid-filled chambers arranged in the forefoot region, as described in greater detail below. Additionally or alternatively, the fluid-filled chamber(s) 246 may be replaced or supplemented with other cushioning elements. For example, the cushion may include a foam block that replaces or supplements the pressurized fluid. The foam block(s) may be received within the chamber 246 defined by the upper barrier layer 248 and the lower barrier layer 250. Positioning the foam block(s) within the chamber 246 defined by the upper barrier layer 248 and the lower barrier layer 250 allows the barrier layers to restrict expansion of the foam blocks beyond a predetermined amount when subjected to a predetermined load. Accordingly, the overall shape and, thus, the performance of the foam blocks may be controlled by allowing the foam blocks to interact with the barrier layers 248, 250 during loading. While the foam blocks are described as being received within the chamber 246 of the barrier layers 248, 250, the foam blocks could alternatively be positioned between the chassis plate 202 and the outsole plate 212 absent the barrier layers 248, 250. In such a configuration, the foam blocks would be directly attached to the lower surface 220 of the chassis plate 202 and to outsole plate 212, respectively.

With continued reference to FIGS. 1 and 2, the outsole plate 212 extends continuously from a first end 262 at the anterior end 18 of the article of footwear 10 to a second end 264 at the posterior end 20 of the article of footwear. The outsole plate 212 further includes an upper surface 266 facing the upper 100 and a lower surface 268 formed on an opposite side of the outsole plate 212 from the upper surface 266. A peripheral side surface extends between the upper surface 266 and the lower surface 268 and defines an outer periphery of the outsole plate 212. The upper surface 266 of the first end 262 of the outsole plate 212 is attached to the lower surface 228 of the forefoot pad 206 in the toe portion $\mathbf{12}_T$. Similarly, the upper surface 266 of the second end 264 of the outsole plate 212 is attached to the lower surface 238 of the heel pad 208 in the heel region 16.

As shown in FIGS. 1 and 2, the upper surface 266 of the outsole plate 212 is spaced apart from the lower surface 220 of the chassis plate 202 to define a cavity 274 between the chassis plate 202 and the outsole plate 212 for receiving the cushion 210. The cushion 210 is disposed within the cavity 274 in the ball portion $\mathbf{12}_B$ of the forefoot region 12 such that the upper barrier layer 248 is attached to the lower surface 220 of the chassis plate 202, while the lower barrier layer 250 is attached to the upper surface 266 of the outsole plate 212. Accordingly, bending of the outsole plate 212 along the cavity 274 may be attenuated by the cushion 210.

The first end 242 of the cushion 210 faces and is spaced apart from the second end 224 of the forefoot pad 206 such that a first gap or void 276 of the cavity 274 is formed between the cushion 210 and the forefoot pad 206. Here, the first void 276 extends continuously from the medial side 22 to the lateral side 24 across a width of the sole structure 200 within the forefoot region 12. Similarly, the second end 244 of the cushion 210 is spaced apart from the first end 232 of the heel pad 208 such that a second gap or void 278 is formed between the between the cushion 210 and the heel pad 208. The second void 278 extends continuously from the medial side 22 to the lateral side 24 across the width of the sole structure 200 in the mid-foot region 14. Accordingly, while the cushion 210 provides support between the chassis plate 202 and the outsole plate 212 in the ball portion $\mathbf{12}_B$, the outsole plate 212 is not directly supported within the mid-foot region 14.

The lower surface 268 of the outsole plate 212 forms the ground-engaging surface 26 of the article of footwear 10, and may include a plurality of traction elements 280. In the example of FIGS. 1-7, the traction elements 280 are integrally molded with the bottom surface 268 of the outsole plate 212 and are disposed in the forefoot region 12 and the heel region 16. Accordingly, the mid-foot region 14 of the outsole plate 212, which corresponds with the position of the second void 278, is free of the traction elements.

With particular reference to FIGS. 8-13, an article of footwear 10*a* is provided and includes the upper 100 and a sole structure 200*a* attached to the upper 100. In view of the substantial similarity in structure and function of the components associated with the article of footwear 10 with respect to the article of footwear 10*a*, like reference numerals are used hereinafter and in the drawings to identify like components while like reference numerals containing letter extensions are used to identify those components that have been modified.

With reference to FIGS. 8-13, the sole structure 200*a* includes a chassis plate 202*a* extending between the medial side 22 and the lateral side 24 from the anterior end 18 to the posterior end 20. The sole structure 200*a* further includes a midsole 204*a* attached to the chassis plate 202*a* and including the forefoot pad 206 disposed adjacent the anterior end 18 of the chassis plate 202*a*, the heel pad 208 disposed adjacent the posterior end 20 of the chassis plate 202*a*, and the cushion 210 disposed in the forefoot region 12 of the chassis plate 202*a*. The sole structure 200*a* further includes the outsole plate 212 attached to each of the forefoot pad 206, the heel pad 208, and the cushion 210 to define a ground-engaging surface 26 of the article of footwear 10*a*.

Figure 8:
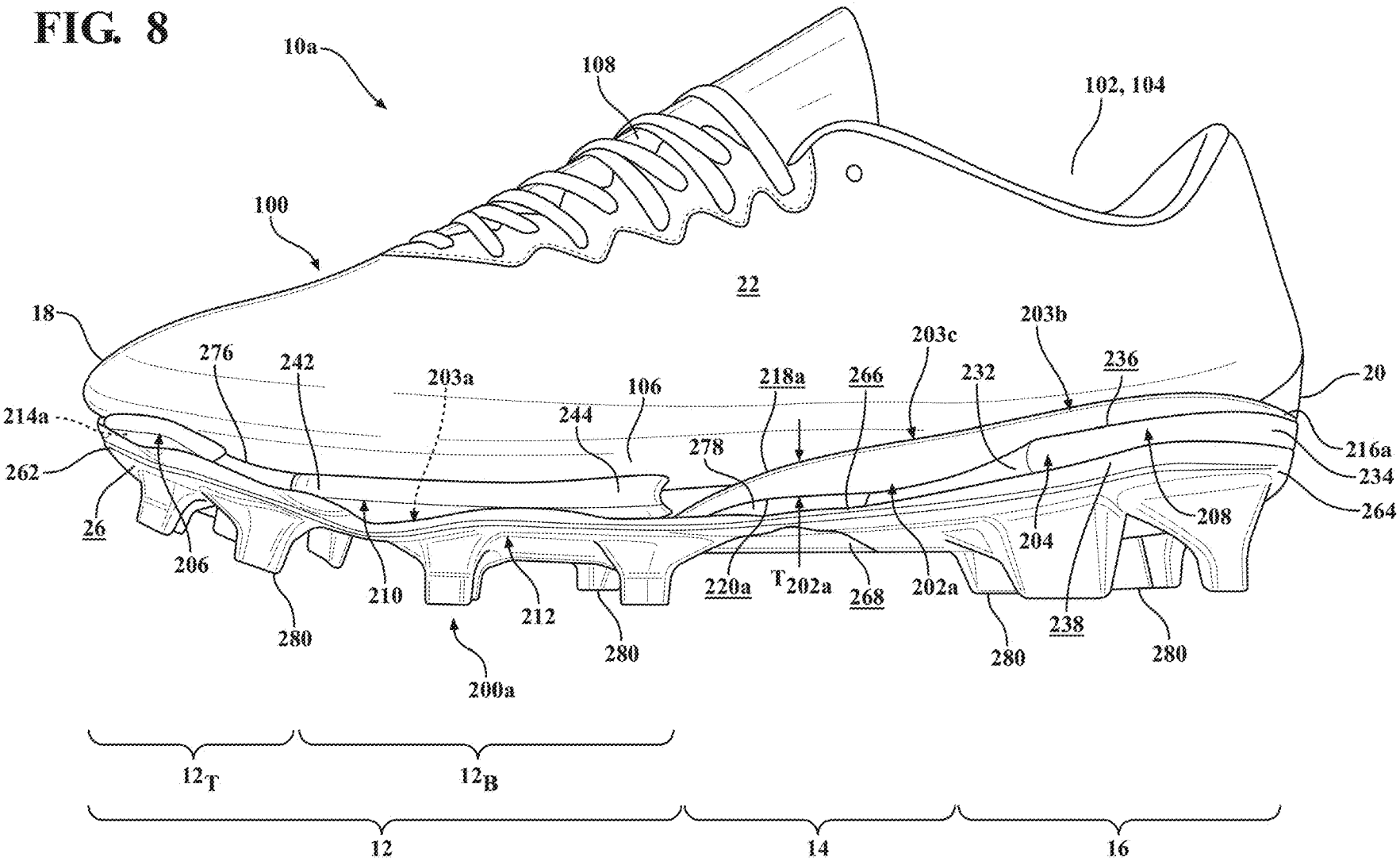
FIGS. 8-13 illustrate another example of an article of footwear including a sole structure in accordance with the principles of the present disclosure.

With reference to FIG. 8, the chassis plate 202*a* extends continuously from a first end 214*a* at the anterior end 18 of the sole structure 200*a* to a second end 216*a* at the posterior end 20, and spans a width of the sole structure 200*a* from the medial side 22 to the lateral side 24. The chassis plate 202*a* further includes an upper surface 218*a* facing the bottom of the upper 100, and a lower surface 220*a* formed on an opposite side of the chassis plate 202*a* from the upper surface 218*a*. A distance from the upper surface 218*a* to the lower surface 220*a* defines a thickness $T_{202a}$ of the chassis plate 202*a*. As discussed above with respect to the chassis plate 202 of FIGS. 1-7, the chassis plate 202*a* of FIGS. 8-13 is formed of a material providing relatively high strength and stiffness, such as polymeric material and/or composite materials.

Unlike the example of the sole structure 200 shown in FIGS. 1-7, where the chassis plate 202*a* extends continuously along the strobel 106 of the upper 100, in the example of FIGS. 8-13 the chassis plate 202*a* may be described as including a forefoot portion 203*a* that is spaced apart from the bottom of the upper 100 by the midsole 204*a*, a heel portion 203*b* that is disposed between the upper 100 and the midsole 204*a*, and a transition portion 203*c* that connects the forefoot portion 203*a* and the heel portion 203*b* in the mid-foot region 14.

As shown, the forefoot portion 203*a* of the chassis plate 202*a* extends from the first end 214*a* and through the forefoot region 12, and is spaced apart from the bottom of the upper 100 by the forefoot pad 206 and the cushion 210. Accordingly, the forefoot pad 206 and the cushion 210 are disposed between the upper surface 218*a* of the chassis plate 202*a* and the strobel 106 of the upper 100 in the forefoot region 12. The forefoot portion 203*a* may include a curvature corresponding to the curvature of a metatarsophalangeal point of the foot of a wearer, such that the upper surface 218*a* of the chassis plate 202*a* is concave through the forefoot portion 203*a*.

In the heel region 16, the heel portion 203*b* is disposed between the strobel 106 and the heel pad 208 such that the upper surface 218*a* of the chassis plate 202*a* is disposed against the strobel 106 and the lower surface 220*a* of the chassis plate 202*a* faces the heel pad 208. In the illustrated example, the lower surface 220*a* of the chassis plate 202*a* is attached to the heel pad 208. The upper surface 218*a* of the heel portion 203*b* may be cupped to receive a heel of a wearer.

The transition portion 203*c* extends through the mid-foot region 14 and connects a posterior end of the forefoot portion 203*a* to an anterior end of the heel portion 203*b*. The transition portion 203*c* is formed to provide a gradual transition from the curvature of the forefoot portion 203*a* to the curvature of the heel portion 203*b*. Accordingly, at an anterior end of the transition portion 203*c*, the upper surface 218*a* is tangent to the concave upper surface 218*a* at the posterior end of the forefoot portion 203*a*. Likewise, at a posterior end of the transition portion 203*c*, the upper surface 218*a* is tangent to the upper surface 218*a* at the anterior end of the heel portion 203*b*. Accordingly, the portion of the upper surface 218*a* defined by the transition portion 203*c* may have a convex curvature extending from the forefoot portion 203*a* to the heel portion 203*b*.

Referring still to FIG. 8, the midsole 204*a* is disposed between the chassis plate 202*a* and the upper 100, and is configured to attenuate forces associated with impact of the sole structure 200*a* with a ground surface. As shown in FIG. 8, the midsole 204*a* includes the forefoot pad 206, the heel pad 208, and the cushion 210.

Figure 9:
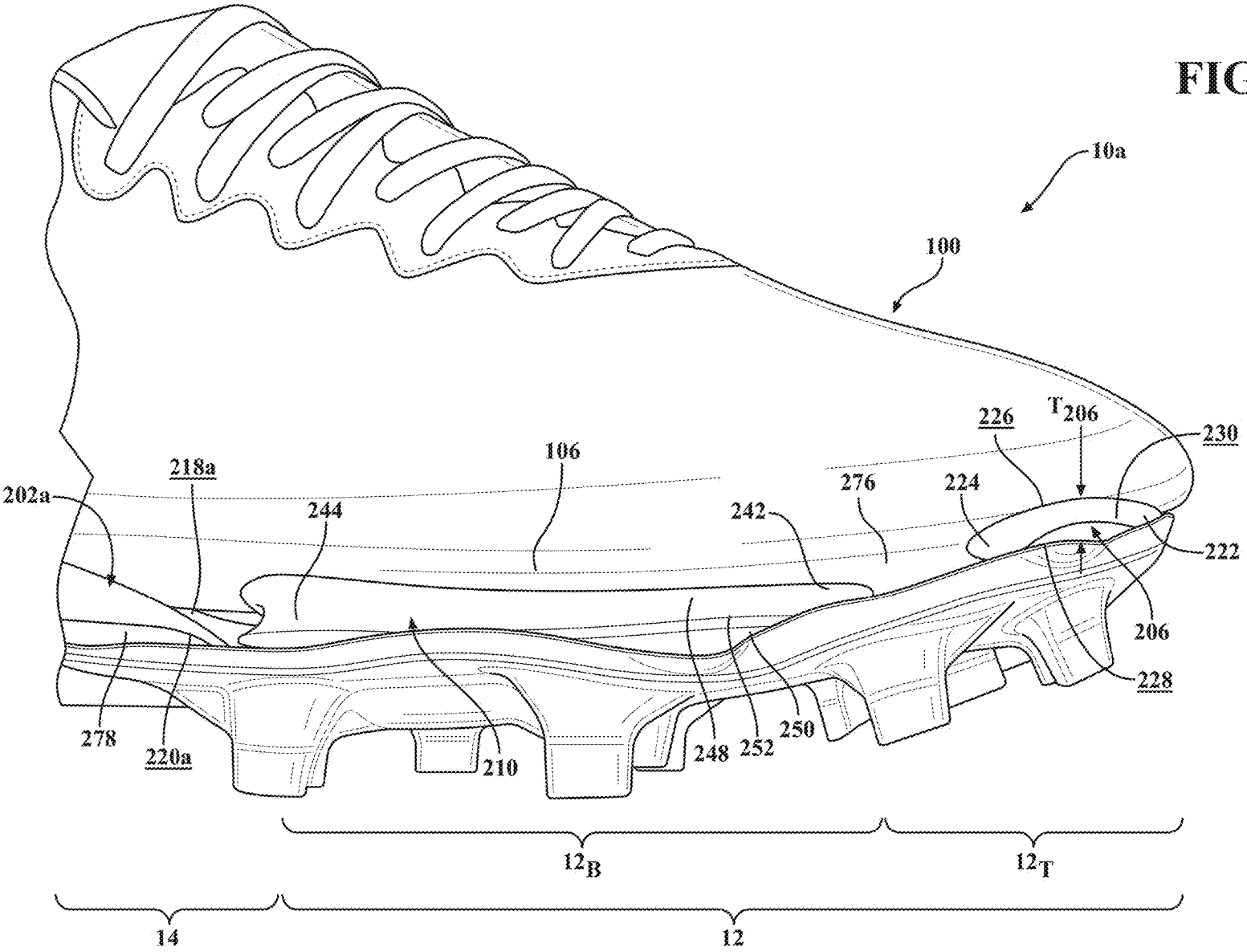
Figure 10:
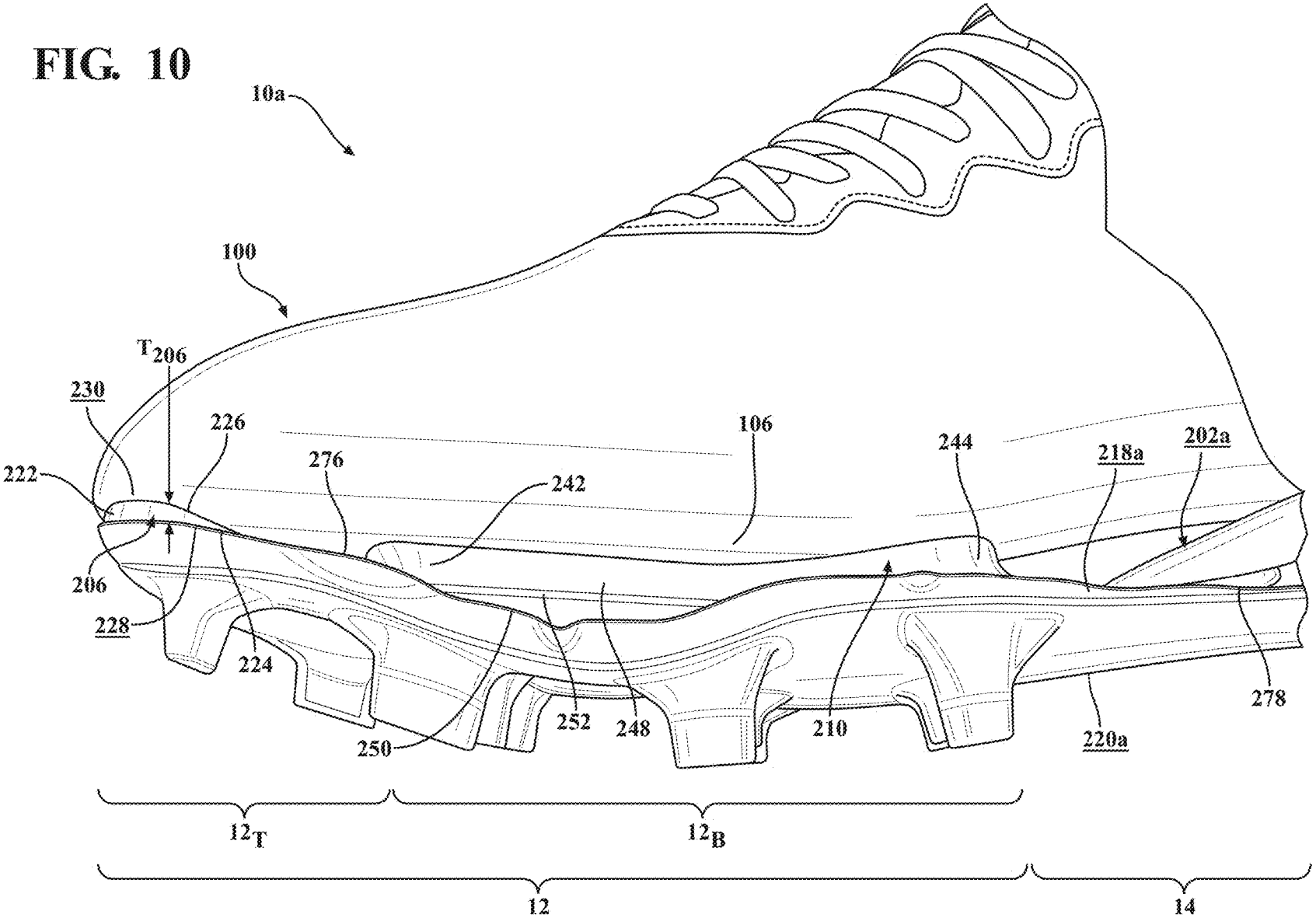
Figure 11:
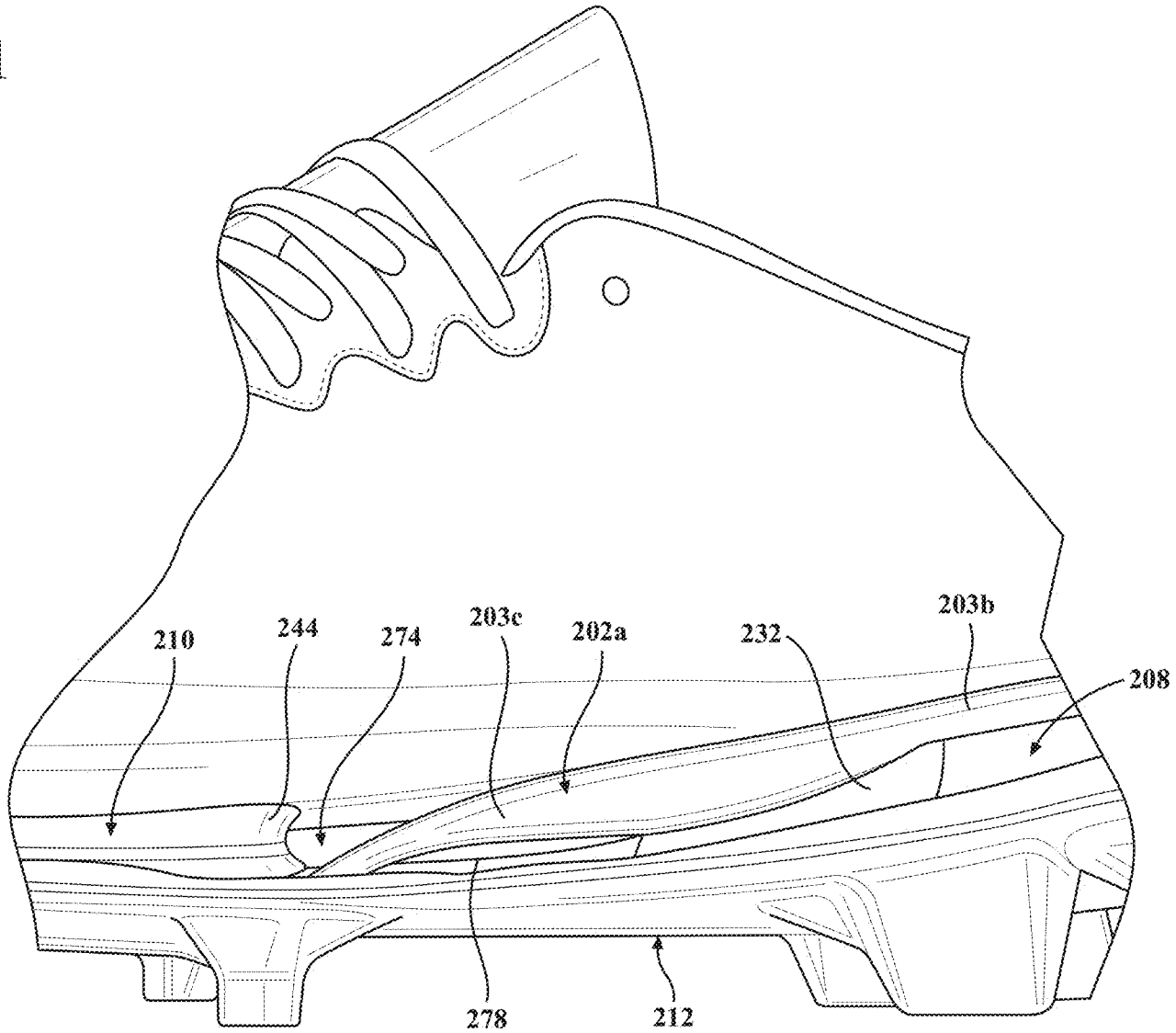

As best shown in FIGS. 9 and 10, the forefoot pad 206 extends from the first end 222 at the anterior end 18 of the sole structure 200*a* to the second end 224 within the forefoot region 12. In the illustrated embodiment, the forefoot pad 206 is disposed within the toe portion $\mathbf{12}_T$ of the forefoot region 12. The upper surface 226 of the forefoot pad 206 is attached to the strobel 106 of the upper 100. The forefoot pad 206 further includes the lower surface 228 formed opposite the upper surface 226, and a peripheral side surface 230 extending between the lower surface 228 and the upper surface 226. As discussed above, the forefoot portion 203*a* of the chassis plate 202*a* is spaced apart from the upper 100 by the cushion 210 and the forefoot pad 206. Accordingly, the lower surface 228 of the forefoot pad 206 faces the upper surface 218*a* of the chassis plate 202*a* along the forefoot portion 203*a*. In some examples, the lower surface 228 of the forefoot pad 206 may be attached directly to the upper surface 218*a* of the chassis plate 202*a*.

Figure 12:
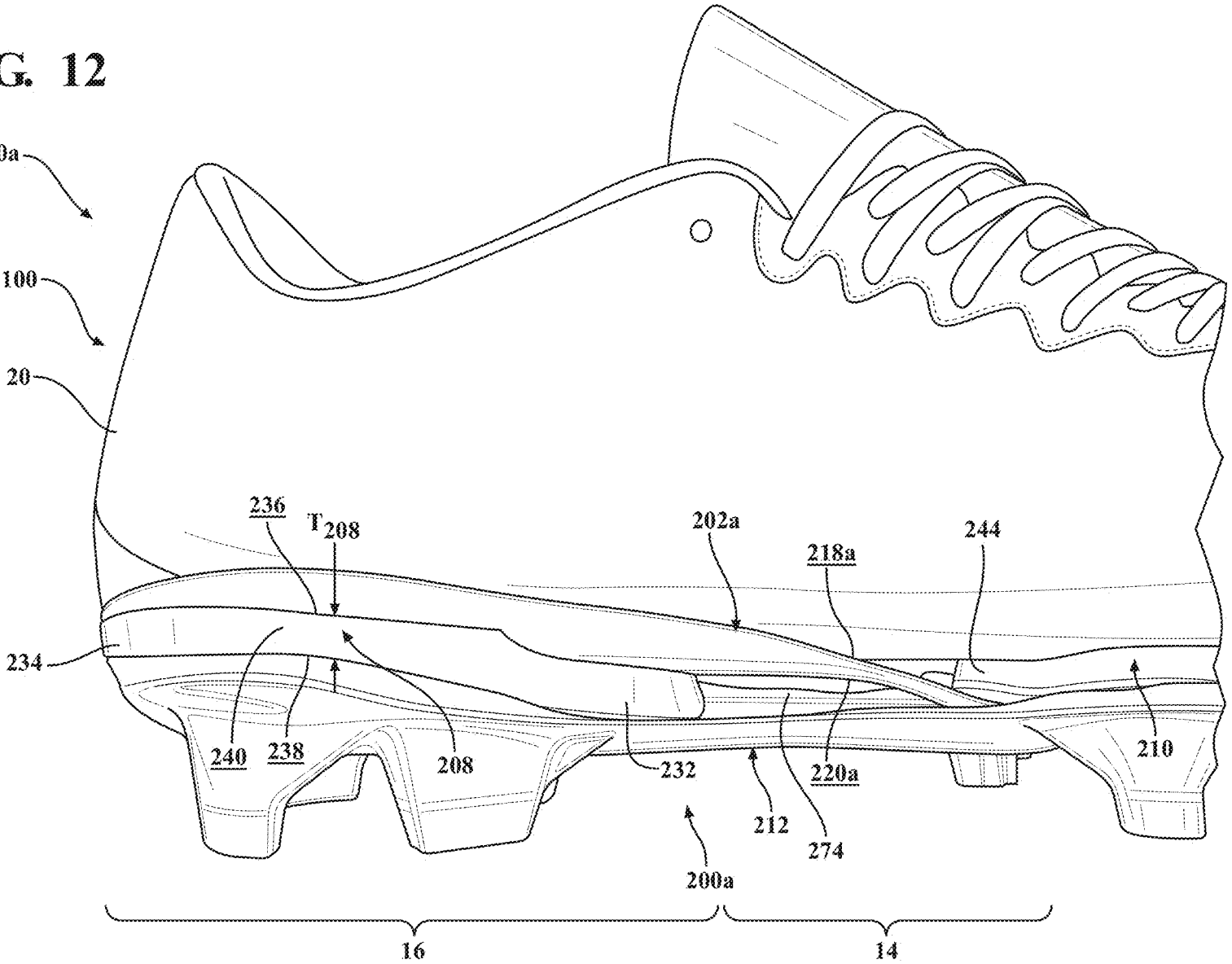
Figure 13:
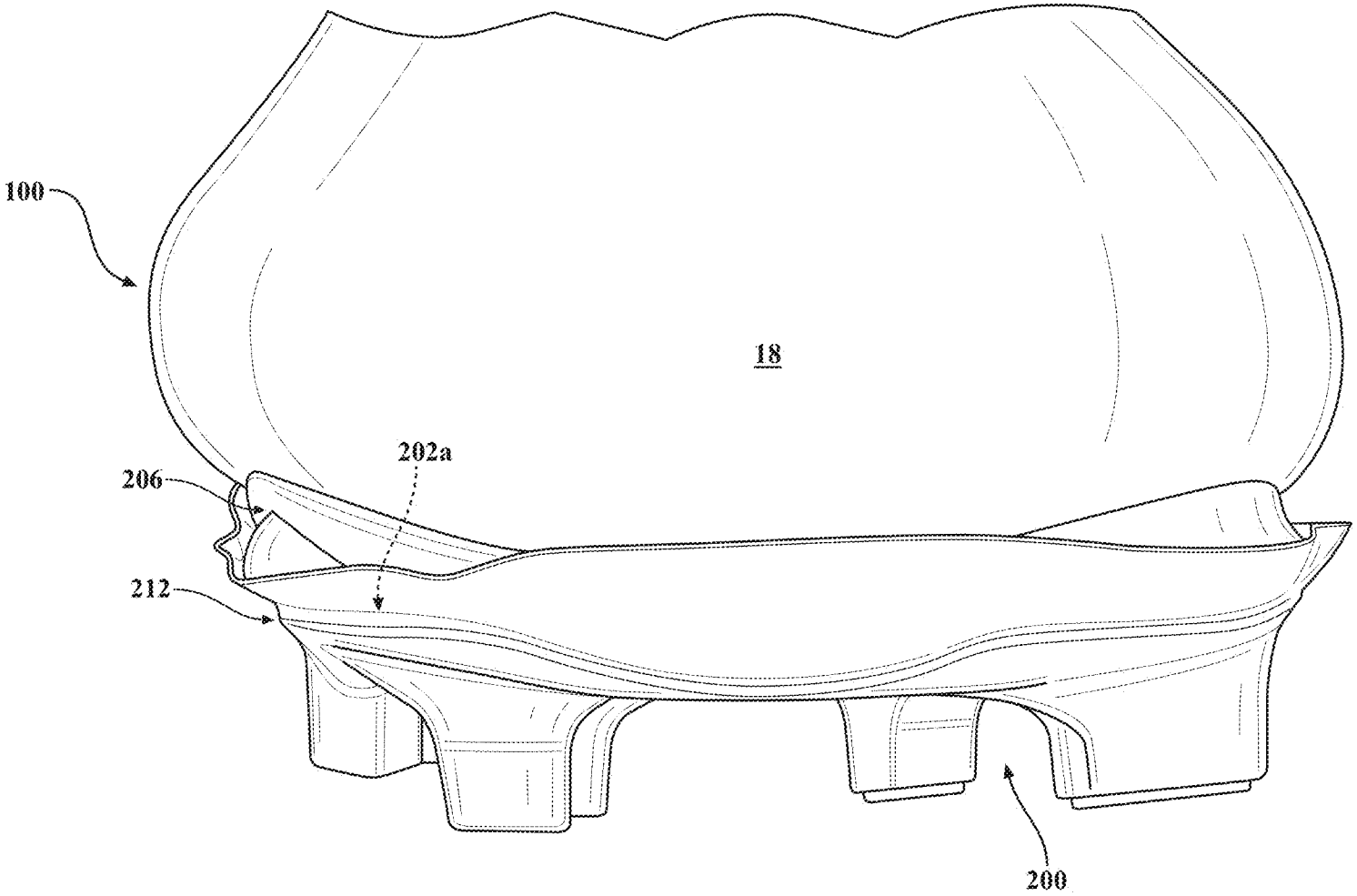

Referring to FIG. 12, the heel pad 208 is attached to the lower surface 220*a* of the chassis plate 202*a* and extends from the first end 232 adjacent to the mid-foot region 14 to the second end 234 at the posterior end 20 of the sole structure 200*a*. The heel pad 208 includes the upper surface 236 attached to the lower surface 220*a* of the chassis plate 202*a*, and a lower surface 238 formed opposite the upper surface 236. The heel pad 208 further includes the peripheral side surface 240 extending between the upper surface 236 and the lower surface 238. In some examples, the upper surface 236 may be concave and curve upwardly towards the peripheral side surface 240 to define a heel cup around the anterior end 18.

With reference to FIGS. 8-10, the cushion 210 is interposed between the strobel 106 of the upper 100 and the forefoot portion 203*a* of the chassis plate 202*a*. Referring to FIG. 9, the cushion 210 is longitudinally positioned along the sole structure 200*a* between the forefoot pad 206 and the heel pad 208, and extends from the first end 242 in the forefoot region 12 to the second end 244 in the mid-foot region 14. The first end 242 of the cushion 210 faces and is spaced apart from the second end 224 of the forefoot pad 206 by the first void 276, as shown in FIG. 9. In one configuration, the cushion 210 extends continuously from the medial side 22 to the lateral side 24 of the sole structure 200*a*. For example, the cushion 210 may extend from a peripheral edge of the outsole plate 212 at the medial side 22 to a peripheral edge of the outsole plate 212 at the lateral side 24. Alternatively, and as discussed in greater detail below, the cushion 210 may be formed as a fragmentary structure, including a plurality of individual chambers spanning the width of the sole structure 200*a* from the medial side 22 to the lateral side 24. Additionally or alternatively, the cushion 210 could alternatively include other cushioning elements (e.g., foam pads), as discussed above with respect to the example of FIGS. 1-7.

With reference to FIG. 8, the outsole plate 212 extends continuously from the first end 262 at the anterior end 18 of the article of footwear 10*a* to the second end 264 at the posterior end 20 of the article of footwear. The outsole plate 212 further includes the upper surface 266 and the lower surface 268 formed on an opposite side of the outsole plate 212 from the upper surface 266. A peripheral side surface extends between the upper surface 266 and the lower surface 268 and defines an outer periphery of the outsole plate 212. In this example, the upper surface 266 of the first end 262 of the outsole plate 212 is attached to the lower surface 220 of the forefoot portion 203*a* of the chassis plate 202*a* such that the chassis plate 202*a* is interposed between the first end 262 of the outsole plate 212 and each of the forefoot pad 206 and the cushion 210. In the heel region 16, the upper surface 266 of the second end 264 of the outsole plate 212 is attached to the lower surface 238 of the heel pad 208 such that the heel pad 208 is interposed between the outsole plate 212 and the heel portion 203*b* of the chassis plate 202*a*.

As shown in FIGS. 8 and 9, the first end 242 of the cushion 210 is spaced apart from the second end 224 forefoot pad 206 such that the first void 276 is formed between the cushion 210 and the forefoot pad 206. Here, the first void 276 extends continuously from the medial side 22 to the lateral side 24 across a width of the sole structure 200*a* within the forefoot region 12. Similarly, the second end 244 of the cushion 210 is spaced apart from the first end 232 of the heel pad 208 such that the second void 278 is formed between the between the cushion 210 and the heel pad 208. The second void 278 extends continuously from the medial side 22 to the lateral side across the width of the sole structure 200*a* in the mid-foot region 14. Accordingly, while the cushion 210 provides support between the chassis plate 202*a* and the outsole plate 212 in the ball portion $\mathbf{12}_B$, the outsole plate 212 is not directly supported within the mid-foot region 14.

The lower surface 268 of the outsole plate 212 forms the ground-engaging surface 26 of the article of footwear 10*a*, and may include a plurality of traction elements 280. In the example of FIGS. 8-13, the traction elements 280 are integrally molded with the lower surface 268 of the outsole plate 212 and are disposed in the forefoot region 12 and the heel region 16. Accordingly, the mid-foot region 14 of the outsole plate 212, which corresponds with the position of the second void 278, is free of the traction elements.

With particular reference to FIGS. 14-18, an article of footwear 10*b* is provided and includes the upper 100 and a sole structure 200*b* attached to the upper 100. In view of the substantial similarity in structure and function of the components associated with the articles of footwear 10, 10*a* with respect to the article of footwear 10*b*, like reference numerals are used hereinafter and in the drawings to identify like components while like reference numerals containing letter extensions are used to identify those components that have been modified.

With reference to FIGS. 14-18, the sole structure 200*b* includes the chassis plate 202*a* described above, which extends between the medial side 22 and the lateral side 24 from the anterior end 18 to the posterior end 20. The sole structure 200*b* further includes a midsole 204*b* including a forefoot pad 206*b* disposed adjacent the anterior end 18 article of footwear 10*b*, a heel pad 208*b* disposed adjacent the posterior end 20 of the article of footwear 10*b*, and a cushion 210*b* disposed in the forefoot region 12. An outsole plate 212*b* is attached to the midsole 204*b* and defines a ground-engaging surface 26 of the article of footwear 10*b*.

Figure 14:
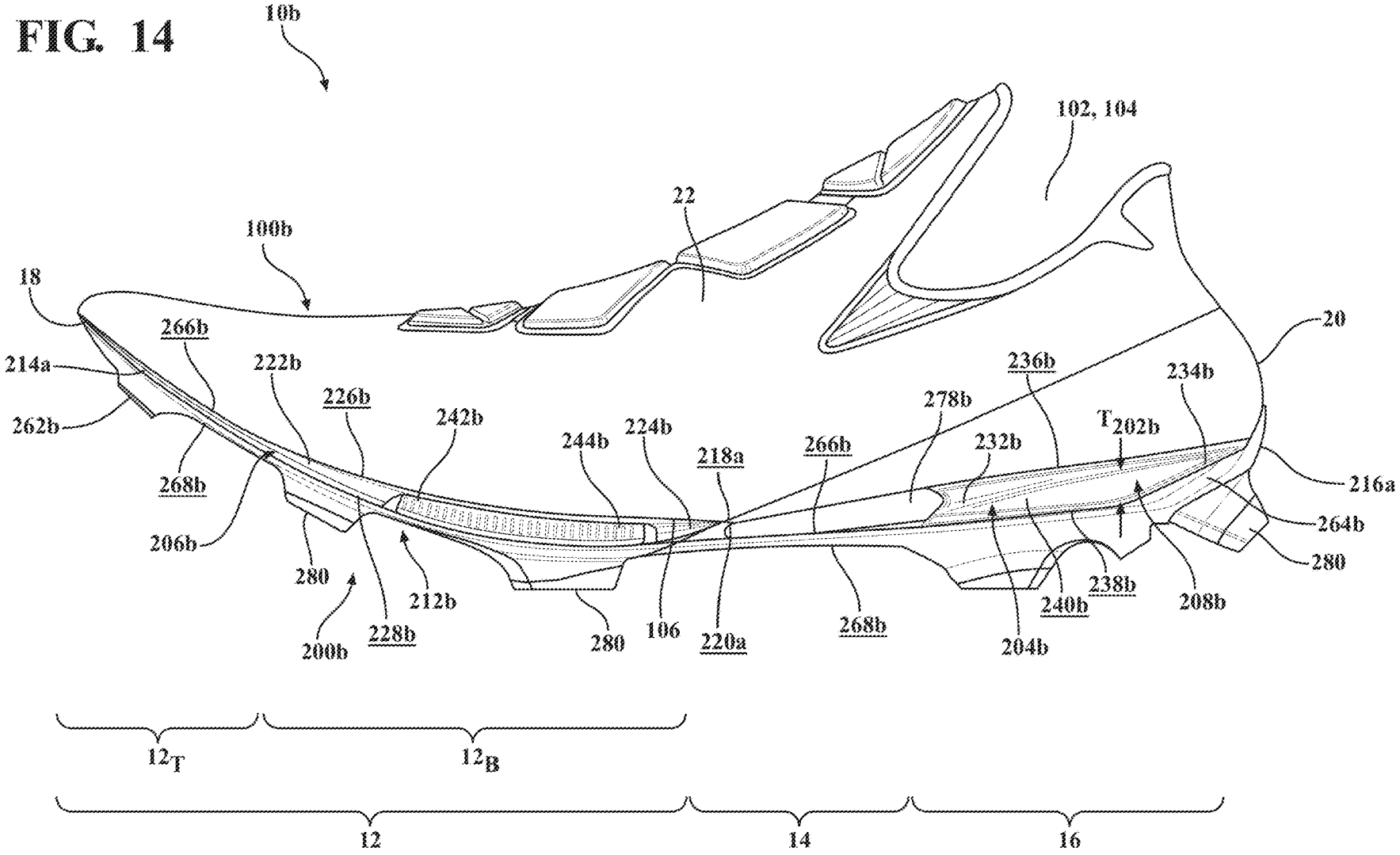
FIGS. 14-18 illustrate yet another example of an article of footwear including a sole structure in accordance with the principles of the present disclosure.

With reference to FIG. 14, the chassis plate 202*a* extends continuously from a first end 214*a* at the anterior end 18 of the sole structure 200*b* to a second end 216*a* at the posterior end 20, and spans a width of the sole structure 200*b* from the medial side 22 to the lateral side 24. The chassis plate 202*a* further includes the upper surface 218*a* facing the bottom of the upper 100, and the lower surface 220*a* formed on an opposite side of the chassis plate 202*a* from the upper surface 218*a*. A distance from the upper surface 218*a* to the lower surface 220*a* defines the thickness $T_{202a}$ of the chassis plate 202*a*.

As discussed previously, the chassis plate 202*a* may be described as including a forefoot portion 203*a* that is spaced apart from the bottom of the upper 100 by the midsole 204*b*, a heel portion 203*b* that is disposed between the upper 100 and the midsole 204*b*, and a transition portion 203*c* that connects the forefoot portion 203*a* and the heel portion 203*b* in the mid-foot region 14. As shown, the forefoot portion 203*a* of the chassis plate 202*a* extends from the first end 214*a* and through the forefoot region 12, and is spaced apart from the bottom of the upper 100 by the forefoot pad 206*b* and the cushion 210*b*. Accordingly, the forefoot pad 206*b* and the cushion 210*b* are disposed between the upper surface 218*a* of the chassis plate 202*a* and the strobel 106 of the upper 100 in the forefoot region 12. In the heel region 16, the heel portion 203*b* is disposed between the strobel 106 and the heel pad 208*b* such that the upper surface 218*a* of the chassis plate 202*a* faces the strobel 106 and the lower surface 220*a* of the chassis plate 202*a* faces the heel pad 208*b*. The upper surface 218*a* of the heel portion 203*b* may be cupped to receive a heel of a wearer.

The transition portion 203*c* extends through the mid-foot region 14 and connects a posterior end of the forefoot portion 203*a* to an anterior end of the heel portion 203*b*. The transition portion 203*c* is formed to provide a gradual transition from the curvature of the forefoot portion 203*a* to the curvature of the heel portion 203*b*. Accordingly, at an anterior end of the transition portion 203*c*, the upper surface 218*a* is tangent to the concave upper surface 218*a* at the posterior end of the forefoot portion 203*a*. Likewise, at a posterior end of the transition portion 203*c*, the upper surface 218*a* is tangent to the upper surface 218*a* at the anterior end of the heel portion 203*b*. Accordingly, the portion of the upper surface 218*a* defined by the transition portion 203*c* may have a convex curvature extending from the forefoot portion 203*a* to the heel portion 203*b*.

Figure 15:
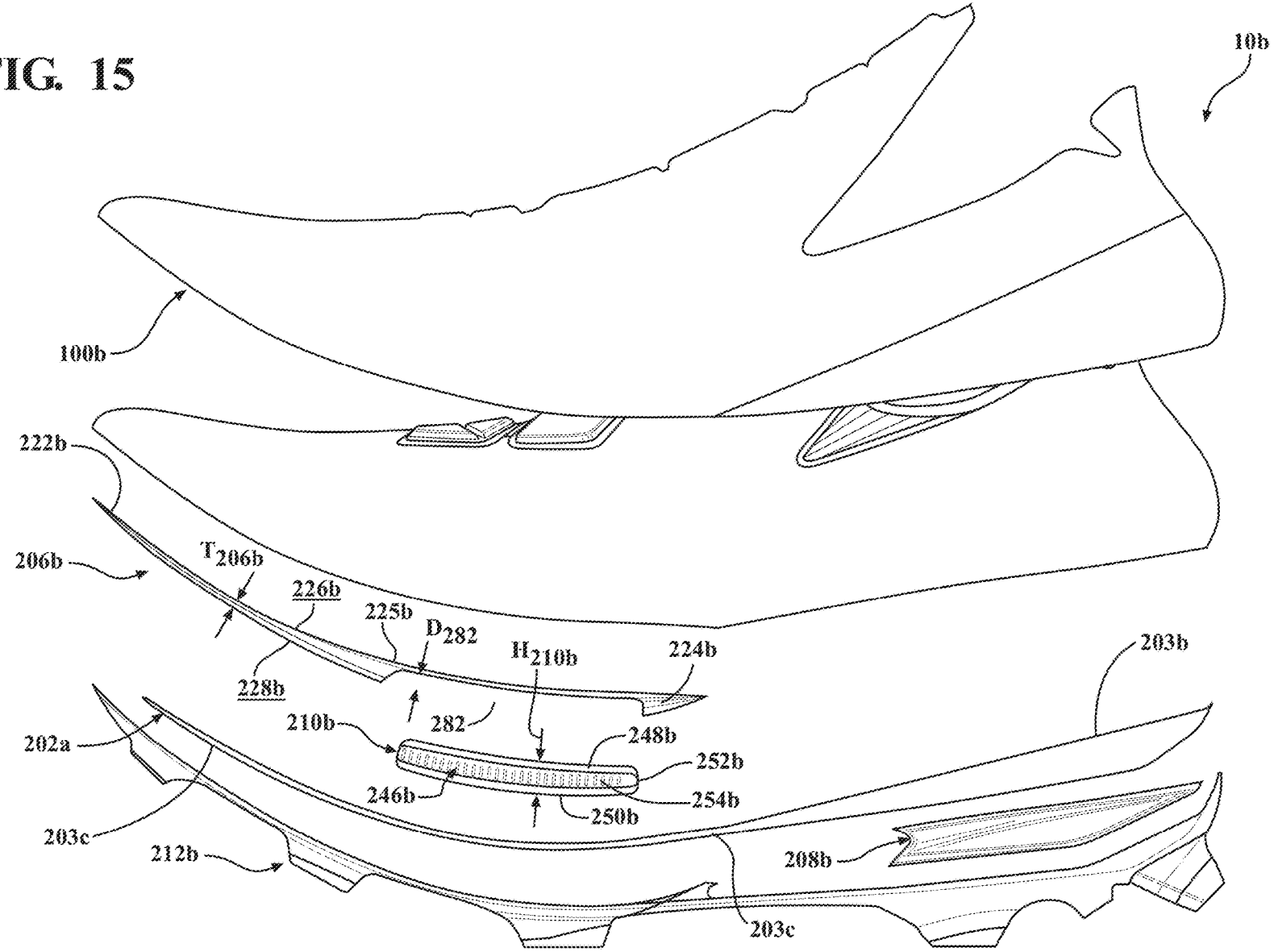

Referring still to FIG. 14, the midsole 204*b* is disposed between the chassis plate 202*a* and the upper 100, and is configured to attenuate forces associated with impact of the sole structure 200*b* with a ground surface. As shown in FIGS. 14 and 15, the midsole 204*b* may be described as including a first portion having the forefoot pad 206*b* and the cushion, and a second portion including the heel pad 208*b*.

As best shown in FIGS. 14 and 15, the forefoot pad 206*b* is formed of a foamed polymeric material, and extends from a first end 222*b* in the forefoot region 12 to a second end 224*b* at the mid-foot region 14 of the sole structure 200*b*. Thus, unlike the previous examples, where the forefoot pad was positioned adjacent to the cushion 210 and within the toe portion $\mathbf{12}_T$ of the sole structure, in the current example the forefoot pad 206*b* extends continuously from the anterior end 18 to the mid-foot region 14. As shown in FIG. 14, the first end 222*b* of the forefoot pad 206*b* is disposed in front of the cushion 210*b* (i.e., adjacent to the anterior end 18) and the second end 224*b* is positioned behind the cushion 210*b* (i.e., towards the posterior end 20). Accordingly, the first end 222*b* and the second end 224*b* are each directly interposed between the chassis plate 202*a* and the strobel 106, while an intermediate portion 225*b* of the forefoot pad 206*b* is disposed between the strobel 106 and the cushion 210*b*.

Figure 16:
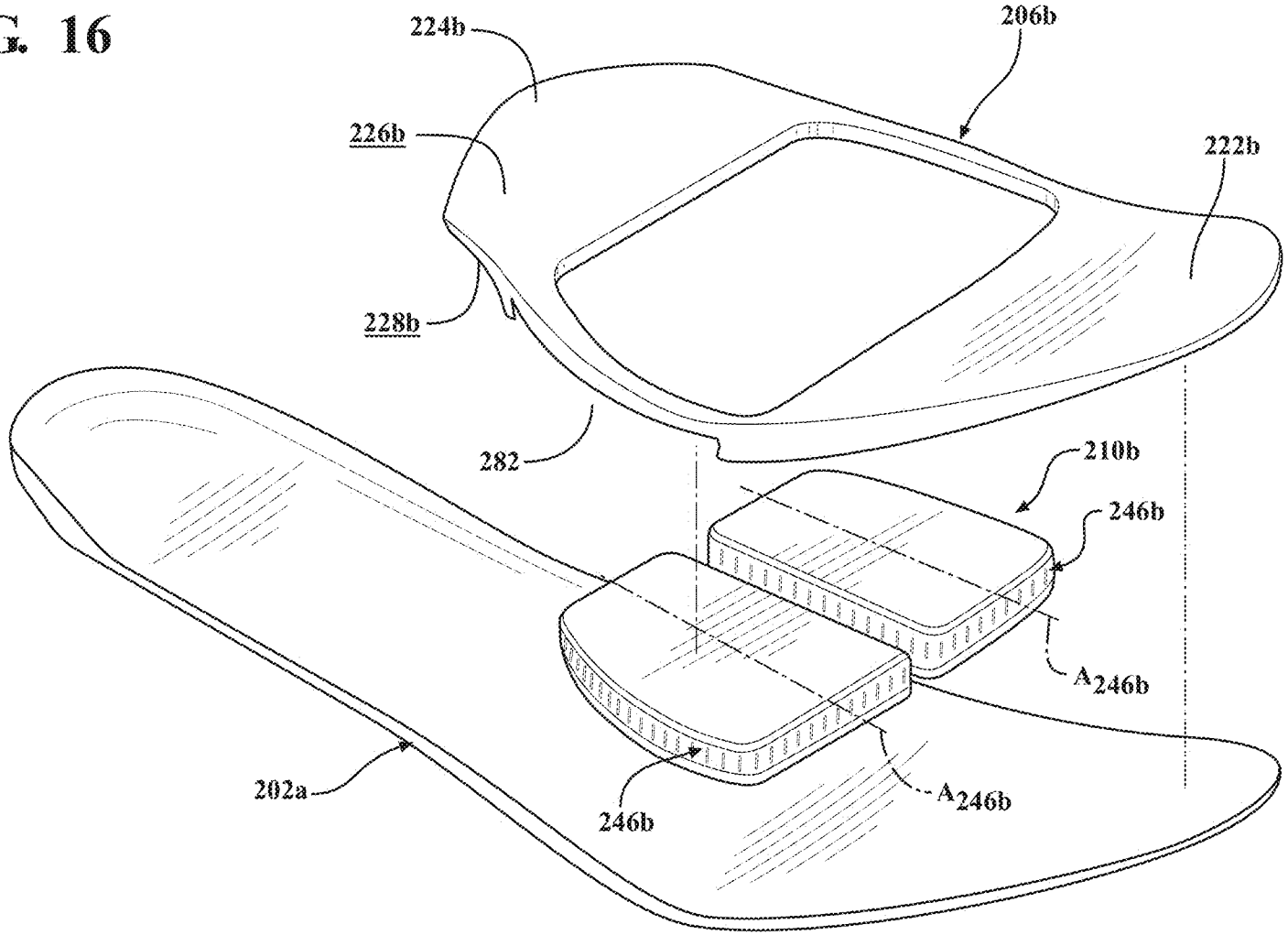
Figure 17:
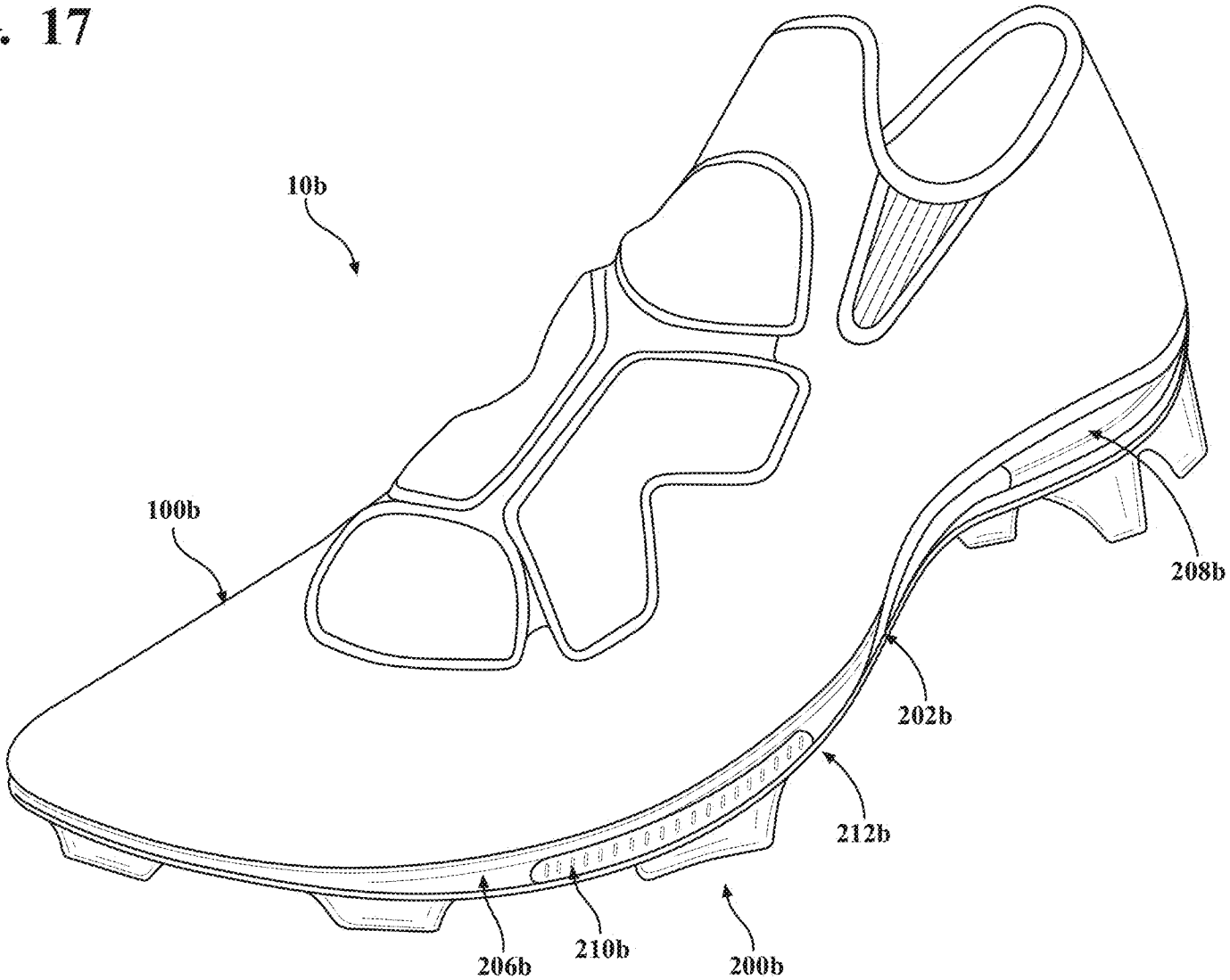
Figure 18:
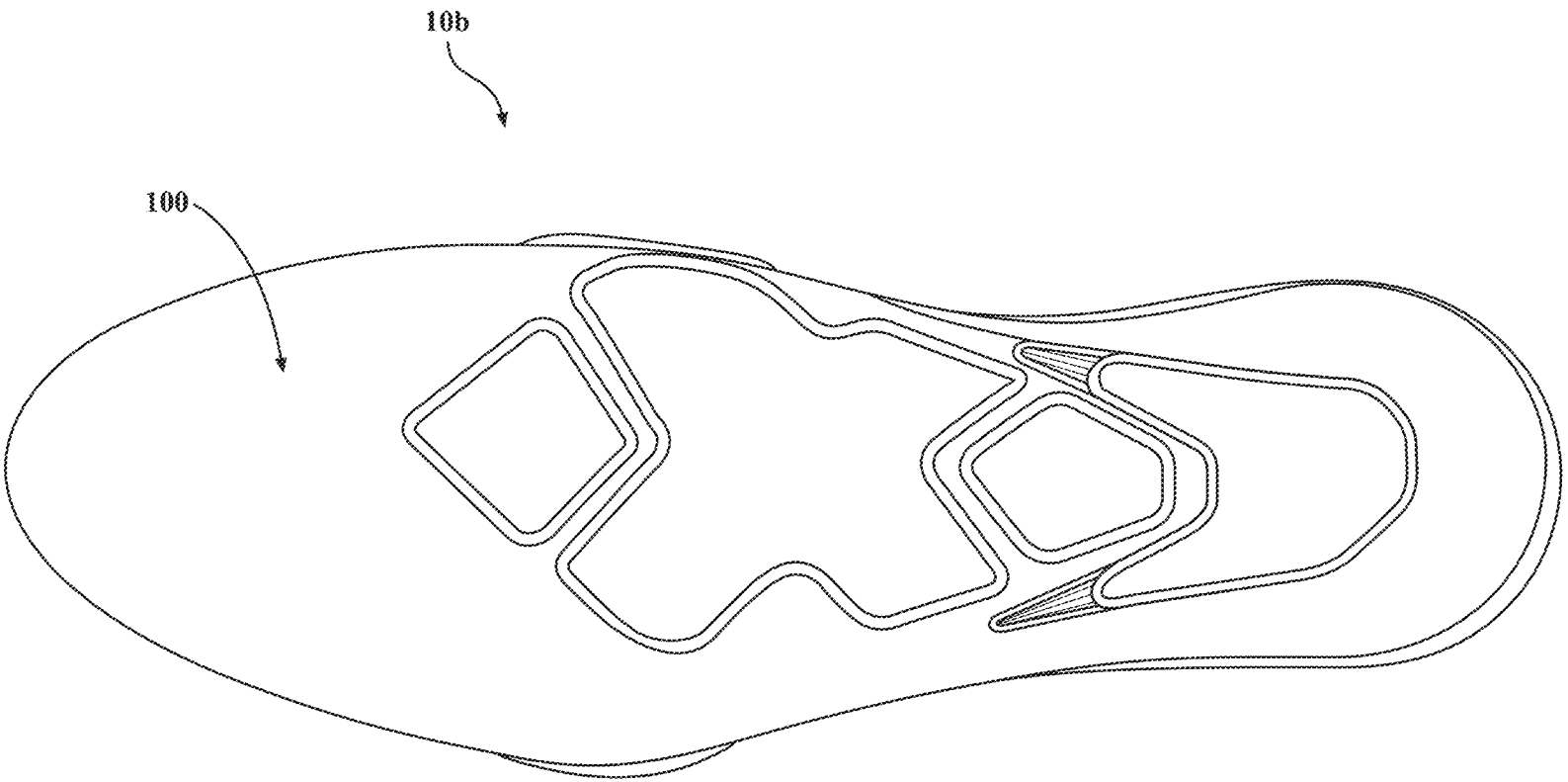

Referring to FIG. 15, the forefoot pad 206*b* may be further described as including an upper surface 226*b* and a lower surface 228*b* formed on an opposite side of the forefoot pad 206*b* than the upper surface 226*b*. A distance from the upper surface 226*b* to the lower surface 228*b* defines a thickness $T_{206b}$ of the forefoot pad 206*b*. With reference to FIGS. 15 and 16, the lower surface 228*b* of the forefoot pad 206*b* may include a recess 282 disposed in the intermediate portion 225*b* between the first end 222*b* and the second end 224*b*. Generally, the recess 282 is configured to receive an upper portion of the cushion 210*b* to secure a position of the cushion 210*b* relative to the forefoot pad 206*b*. Accordingly, the recess 282 has a depth $D_{282}$ corresponding to a height $H_{210b}$ of the cushion 210*b*. Likewise, an outer peripheral profile of the recess 282 corresponds to an outer peripheral profile of the cushion 210*b* While the illustrated example shows a single recess 282, the lower surface 228*b* of the forefoot pad 206*b* may include a plurality of recesses 282 each configured to receive a corresponding portion of the cushion 210*b*.

As discussed above, the first end 222*b* and the second end 224*b* of the forefoot pad 206*b* extend from or overhang opposite ends 242*b*, 244*b* of the cushion 210*b*, such that the first end 222*b* and the second end 224*b* are interposed directly between the strobel 106 and the upper surface 218*a* of the chassis plate 202*a*. In some examples, the thickness $T_{206b}$ of the forefoot pad 206*b* may taper towards at least one of the first end 222*b* and the second end 224*b*. For example, in the illustrated configuration the thickness $T_{206b}$ of the forefoot pad 206*b* tapers in a direction from the intermediate portion 225*b* to each of the first end 222*b* and the second end 224*b*. As such, the upper surface 218*a* of the chassis plate 202*a* converges with the strobel 106 at each of the first end 222*b* and the second end 224*b*.

Referring to FIG. 14, the heel pad 208*b* is attached to the lower surface 220*a* of the chassis plate 202*a* and extends from a first end 232*b* adjacent to the mid-foot region 14 to a second end 234*b* at the posterior end 20 of the sole structure 200*b*. The heel pad 208*b* includes an upper surface 236*b* and a lower surface 238*b* formed opposite the upper surface 236*b*. A distance from the upper surface 236*b* to the lower surface 238*b* defines a thickness $T_{208}b$ of the heel pad 208*b*, which may taper along a direction from the first end 232*b* to the second end 234*b*. As shown, the heel pad 208*b* is interposed between the heel portion 203*b* of the chassis plate 202*a* and the second end 264*b* of the outsole plate 212*b*. Accordingly, the chassis plate 202*a* and the outsole plate 212*b* converge with each other at the posterior end 20 of the article of footwear.

The heel pad 208*b* further includes a peripheral side surface 240*b* extending between the upper surface 236*b* and the lower surface 238*b*. Here, the peripheral side surface 240*b* may have a concave or recessed cross-sectional profile between the upper surface 236*b* and the lower surface 238*b*. Accordingly, the peripheral side surface 240*b* may function as a living hinge or spring element between the upper surface 236*b* and the lower surface 238*b* at the first end 232*b* of the heel pad 208*b* and/or along the sides 22, 24 of the heel pad 208*b*.

With reference to FIG. 14, the cushion 210*b* is interposed between the forefoot pad 206*b* and the forefoot portion 203*a* of the chassis plate 202*a*. As discussed above, the cushion 210*b* is at least partially received within the recess 282 of the forefoot pad 206*b*, and extends from a first end 242*b* in the forefoot region 12 to a second end 244*b* at the mid-foot region 14. As shown, the cushion 210*b* is positioned within the sole structure 200*b* such that the cushion 210*b* is disposed beneath a metatarsophalangeal joint (i.e., the ball) of the foot of the wearer.

In one configuration, the cushion 210*b* extends discontinuously from the medial side 22 to the lateral side 24 of the sole structure 200*b*. Here, the cushion 210*b* includes a plurality of fluid-filled chambers 246*b* positioned within the forefoot region 12. As best shown in FIG. 16, the cushion 210*b* includes a pair of fluid-filled chambers 246*b* constructed in a similar manner as the chamber 246 discussed above. Particularly, each of the chambers 246*b* includes a pair of the barrier layers 248*b*, 250*b* joined together along a peripheral seam 252*b* to enclose a tensile element 254, as shown in FIG. 15.

In this example, the chambers 246*b* are arranged side-by-side within the recess 282 of the forefoot pad 206*b*, such that the chambers 246*b* cooperate to provide continuous support from the medial side 22 to the lateral side 24 in the forefoot region 12. In the illustrated example, the chambers 246*b* are substantially similar to each other, aside from their positioning within the sole structure 200*b*. As shown, each of the chambers 246*b* has an elongate, rectangular shape extending along a longitudinal axis $A_{246b}$ that is arranged parallel to a longitudinal axis (i.e., axis extending from the anterior end 18 to the posterior end 20) of the article of footwear 10*b*. However, in other examples, the chambers 246*b* may be configured different from each other. For example, one of the chambers 246*b* may have a different size or hardness from the other. Alternatively, the dual-chambered cushion 210*b* may be replaced with a single unitary cushion, such as the cushion 210 described above. While the cushion 210*b* is described and shown as a bladder 210*b* including the fluid-filled chambers 246*b*, the cushion 210*b* could alternatively include other cushioning elements, as described above with respect to the cushion 210.

With reference to FIG. 14, the outsole plate 212*b* extends continuously from a first end 262*b* at the anterior end 18 of the article of footwear 10 to a second end 264*b* at the posterior end 20 of the article of footwear 10*b*. The outsole plate 212*b* further includes an upper surface 266*b* and a lower surface 268*b* formed on an opposite side of the outsole plate 212*b* from the upper surface 266*b*. Here, the upper surface 266*b* of the outsole plate 212*b* is attached to the strobel 106 in the toe portion $\mathbf{12}_T$. In the ball region $\mathbf{12}_B$, the upper surface 266*b* of the outsole plate 212*b* is attached to the lower surface 228*b* of the forefoot pad 206*b* and the lower barrier layer 250*b* of the cushion 210*b*.

With continued reference to FIG. 14, the chassis plate 202*a* diverges from the upper surface 266*b* of the outsole plate 212*b* along a direction from the forefoot region 12 to the heel region 16 such that a gap or void 278*b* is formed between the chassis plate 202*a* and the outsole plate 212*b* in the mid-foot region 14. The void 278*b* extends through a width of the sole structure 200*b* from the medial side 22 to the lateral side 24. In the heel region, the upper surface 266*b* of the outsole plate 212*b* is separated from the lower surface 220*a* of the chassis plate 202*a* by the heel pad 208*b*, such that the upper surface 266*b* of the outsole plate 212*b* is attached to the lower surface 238*b* of the heel pad 208*b*.

The lower surface 268*b* of the outsole plate 212*b* forms the ground-engaging surface 26 of the article of footwear 10*b*, and may include a plurality of traction elements 280. In the example of FIGS. 14-18, the traction elements 280 are integrally molded with the bottom surface 268*b* of the outsole plate 212*b* and are disposed in the forefoot region 12 and the heel region 16. Accordingly, the mid-foot region 14 of the outsole plate 212*b*, which corresponds with the position of the void 278*b*, is free of the traction elements.

Figure 19:
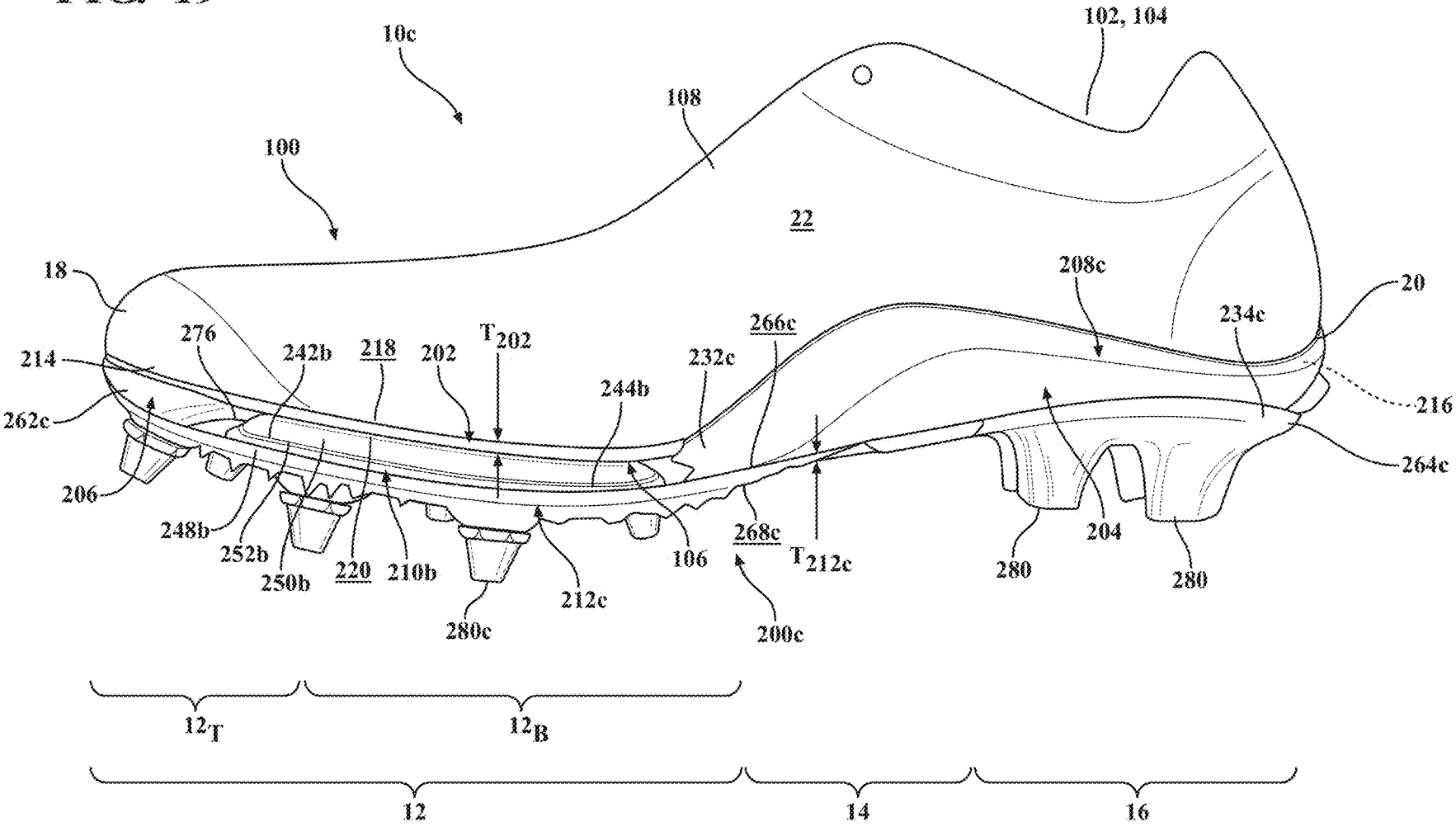
FIGS. 19-21 illustrate an alternative example of an article of footwear including a sole structure in accordance with the principles of the present disclosure.
Figure 20:
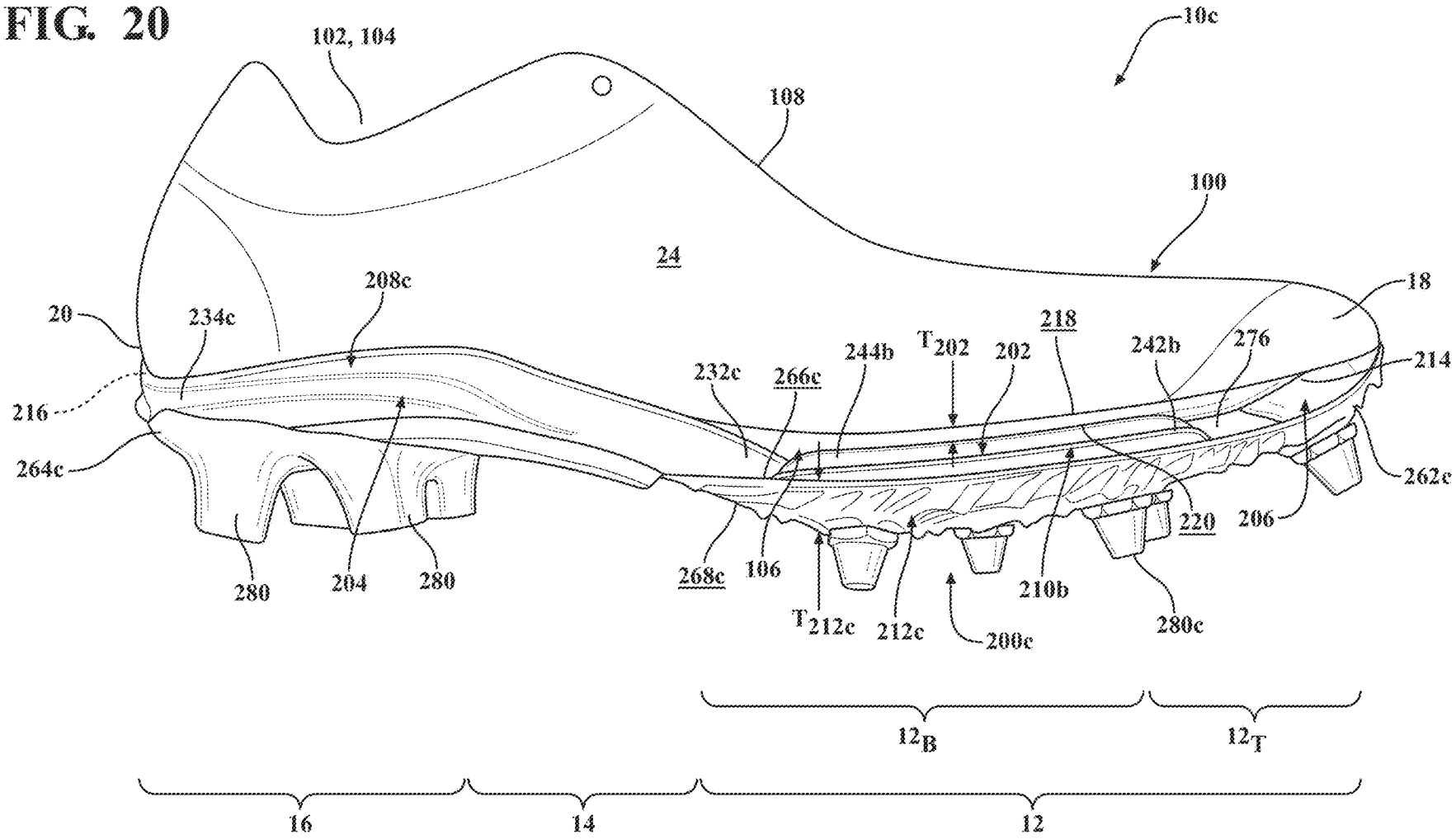
Figure 21:
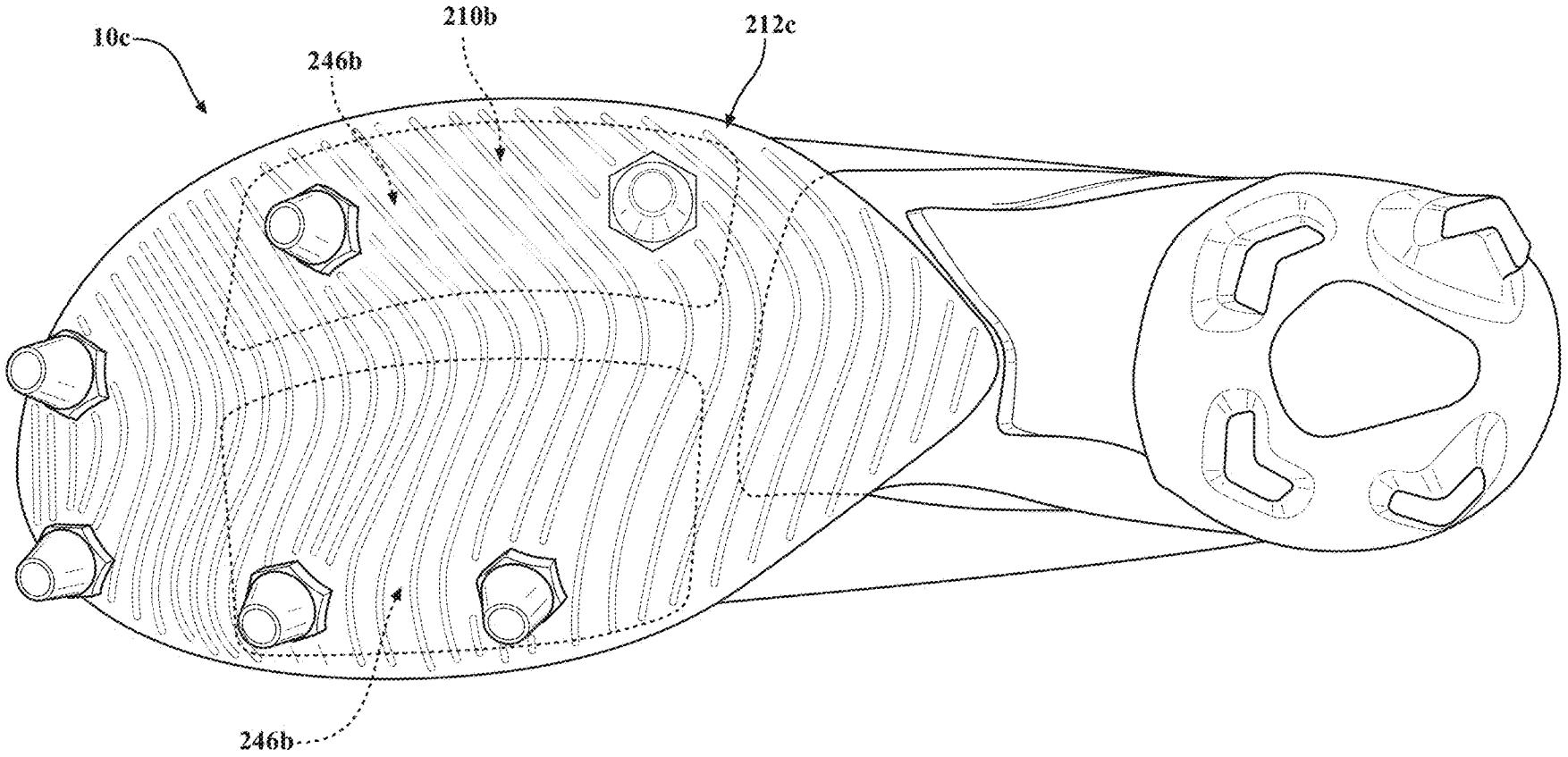

With particular reference to FIGS. 19-21, an article of footwear 10*c* is provided and includes the upper 100 and a sole structure 200*c* attached to the upper 100. In view of the substantial similarity in structure and function of the components associated with the article of footwear 10 with respect to the article of footwear 10*c*, like reference numerals are used hereinafter and in the drawings to identify like components while like reference numerals containing letter extensions are used to identify those components that have been modified.

As shown in FIGS. 19 and 20, the article of footwear 10*c* is constructed in a similar fashion as the article of footwear 10 discussed above with respect to FIGS. 1-7. That is, the sole structure 200*c* includes: the full-length chassis plate 202 extending along an entire length of the strobel 106; a midsole 204*c* including the forefoot pad 206, the dual-chambered cushion 210*b*, and a modified heel pad 208*c*; and an outsole plate 212*c* extending along an entire length of the sole structure 200*c* and defining the ground-engaging surface 26 of the article of footwear 10*c*.

With reference to FIG. 21, the midsole 204*c* includes the cushion 210*b* discussed above with respect to the example in FIGS. 14-18. However, in this configuration, where the forefoot pad 206 is disposed within the toe portion $\mathbf{12}_T$, the upper barrier layer 248*b* of each chamber 246*b* is attached directly to the lower surface 218 of the chassis plate 202 and the lower barrier layer 250*b* is attached to the upper surface 266*c* of the outsole plate 212*c*.

In the illustrated example, the heel pad 208*c* extends continuously from a first end 232*c* adjacent to the second end 244*b* of the cushion 210*b* to a second end 234*c* at the posterior end 20 of the sole structure 200. Accordingly, unlike the heel pad 208 of FIGS. 1-7, which is spaced apart from the cushion 210 by the second void 278 in the mid-foot region 14, the heel pad 208*c* of the current example is disposed adjacent to the cushion 210*b* such that the chassis plate 202 and the outsole plate 212*c* are continuously connected by the midsole 204*c* through the mid-foot region 14.

The outsole plate 212*c* is substantially similar to the outsole plates 212 discussed above, and extends continuously from the anterior end 18 to the posterior end 20. However, in some examples, the outsole plate 212*c* may include one or more detachable traction elements 280*c*. In the illustrated example, the outsole plate 212*c* includes detachable traction elements 280*c* in the forefoot region, and includes the molded traction elements 280 in the heel region 16.

With particular reference to FIGS. 22-25, an article of footwear 10*d* is provided and includes the upper 100 and a sole structure 200*d* attached to the upper 100. In view of the substantial similarity in structure and function of the components associated with the article of footwear 10 with respect to the article of footwear 10*d*, like reference numerals are used hereinafter and in the drawings to identify like components while like reference numerals containing letter extensions are used to identify those components that have been modified.

Figure 22:
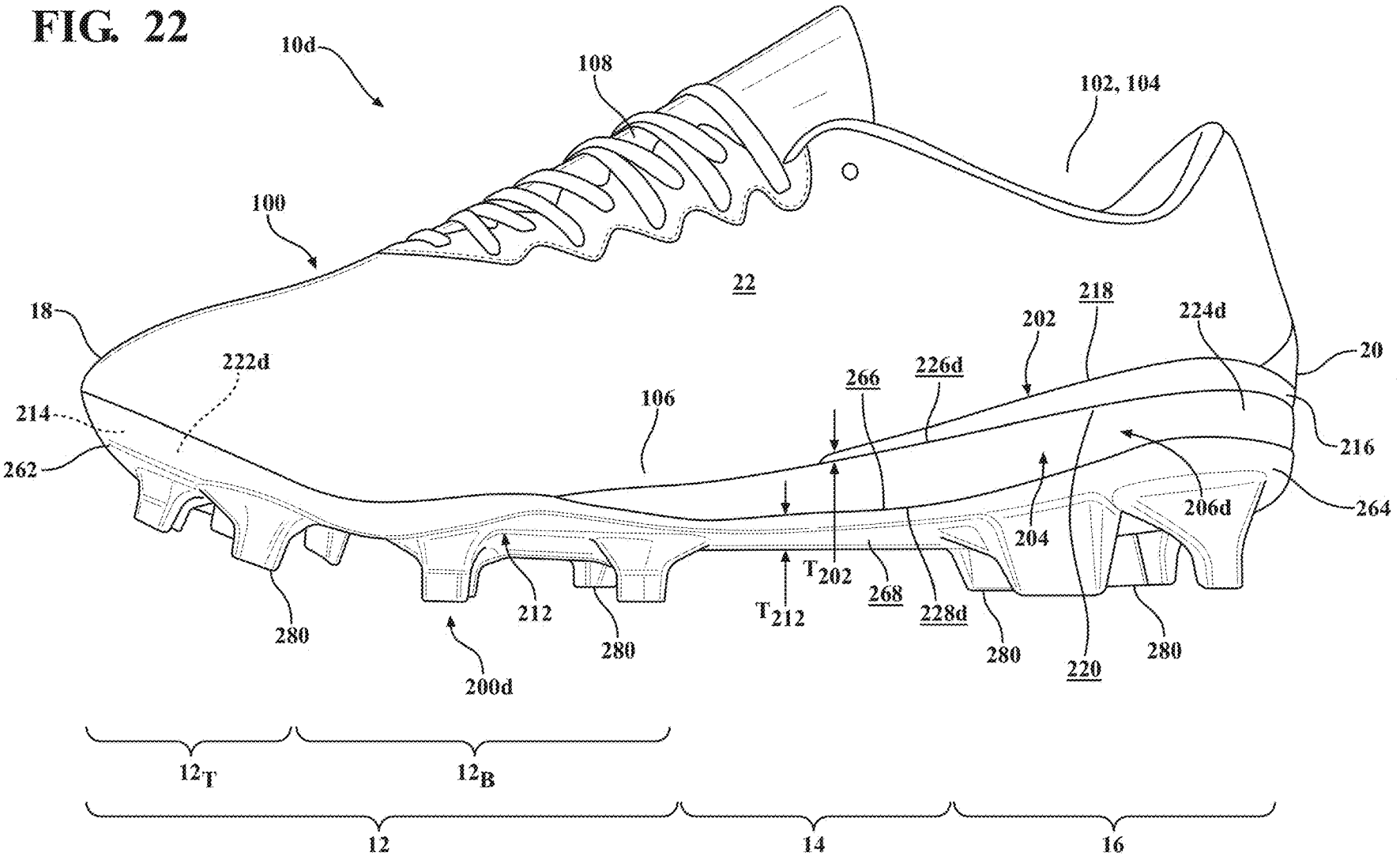
FIGS. 22-25 illustrate yet another example of an article of footwear including a sole structure in accordance with the principles of the present disclosure.
Figure 23:
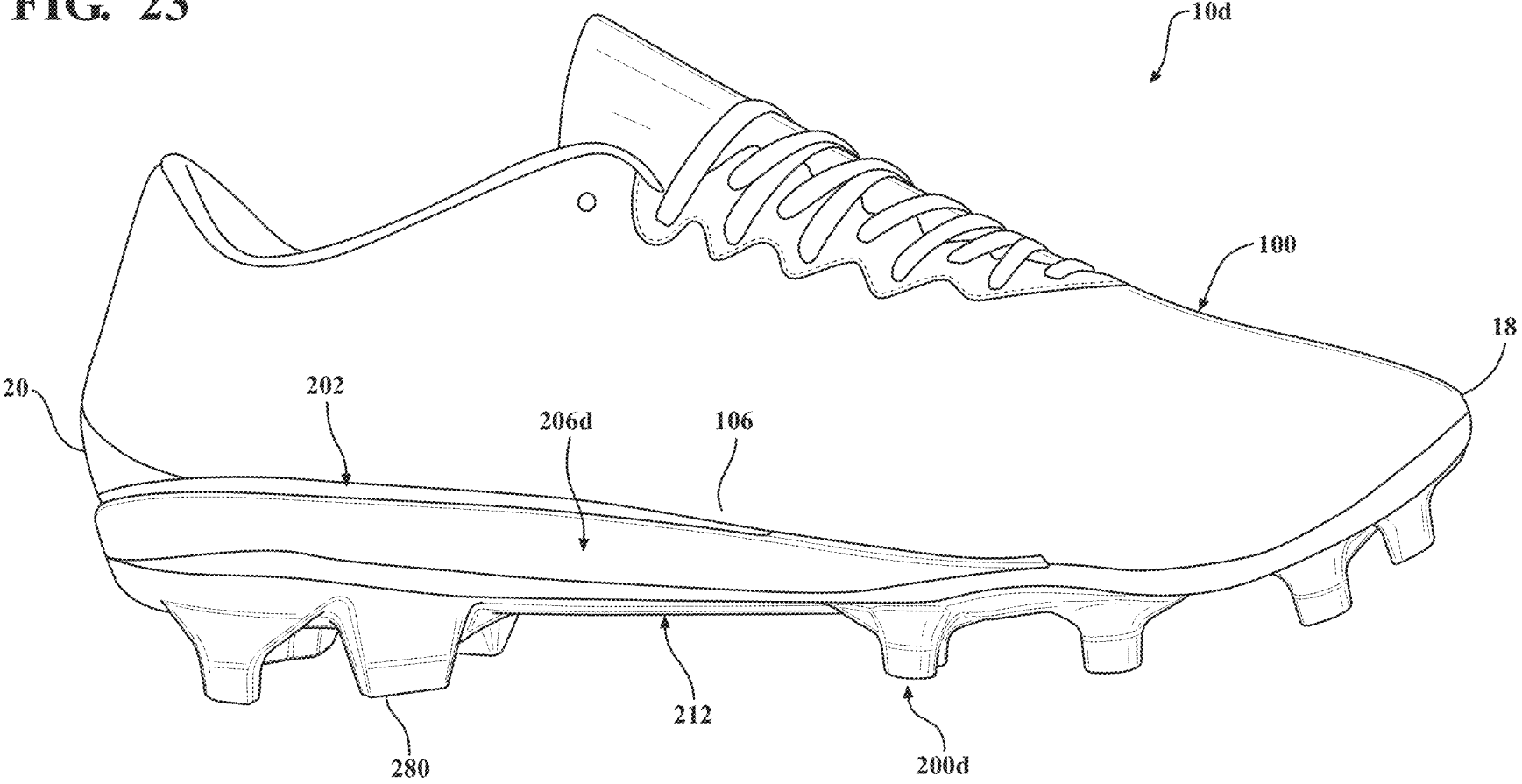

As shown in FIG. 22, the article of footwear 10*d* is constructed in a similar fashion as the article of footwear 10 discussed above with respect to FIGS. 1-7. That is, the sole structure 200*d* includes the full-length chassis plate 202 extending along the strobel 106, the outsole plate 212 extending along an entire length of the sole structure 200*d* and defining the ground-engaging surface 26 of the article of footwear 10*d*, and a midsole 204*d* disposed between the chassis plate 202 and the outsole plate 212 and providing cushioning characteristics.

Figure 24:
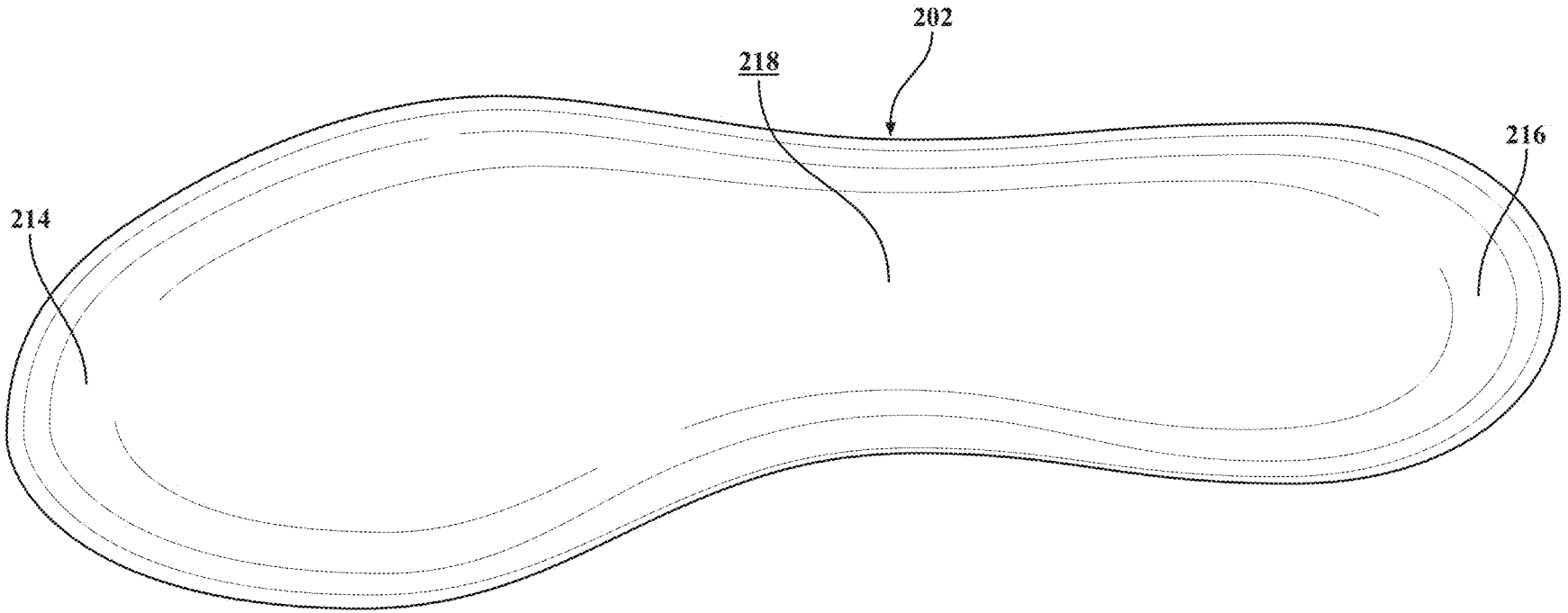
Figure 25:
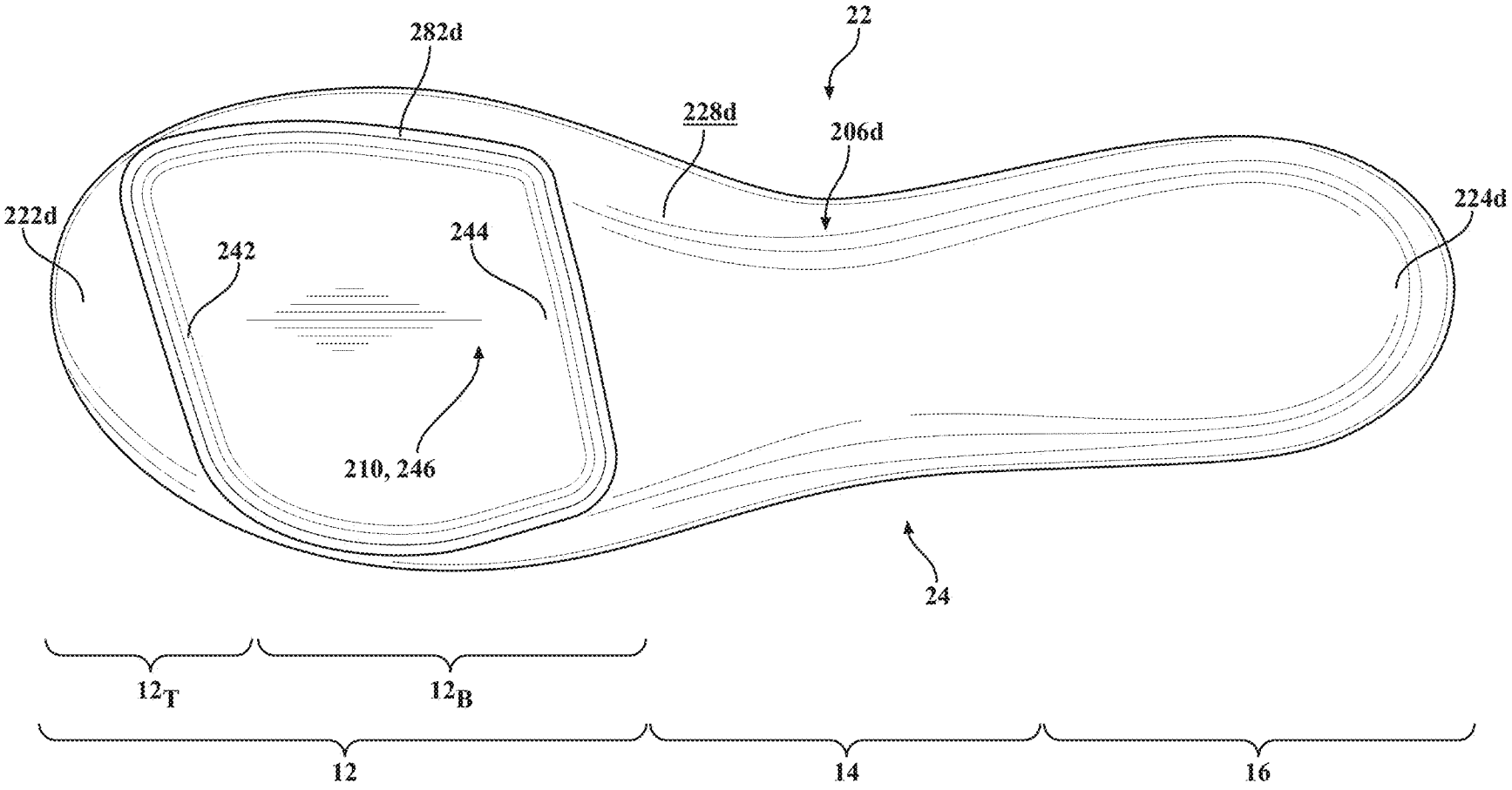

Unlike previous examples, where the midsoles included separately formed forefoot pads and heel pads, in the current example, the midsole 204*d* includes a full-length pad 206*d* extending from a first end 222*d* at the anterior end 18 of the sole structure 200*d* to a second end 224*d* at the posterior end 20 of the sole structure 200*d*. Here, an upper surface 226*d* of the pad 206*d* faces the lower surface 220 of the full-length chassis plate 202. As shown in FIGS. 24 and 25 an outer peripheral profile of the pad 206*d* corresponds to an outer peripheral profile of the chassis plate 202 such that the chassis plate 202 (FIG. 24) covers the upper surface 226*d* of the pad 206*d* and the pad 206*d* covers the lower surface 220 of the chassis plate 202.

With continued reference to FIG. 25, the lower surface 228*d* of the pad 206*d* includes a recess 282*d* configured to receive at least an upper portion of the cushion 210 therein. Here, the recess 282*d* is disposed within the forefoot region 12 of the pad 206*d*, such that the cushion 210 will be positioned in a region corresponding to the metatarsophalangeal joint of the foot of the wearer when the sole structure 200*d* is assembled. As shown, the cushion 210 is a unitary cushion having a single chamber 246 extending from the medial side 22 to the lateral side 24. However, the cushion may be embodied as a multi-chambered cushion, such as the dual-chambered cushion 210*b* discussed above, and may optionally include one or more foam elements.

The following Clauses provide configurations for a sole structure for an article of footwear described above.

Clause 1: A sole structure for an article of footwear including an upper, the sole structure including a first plate extending from a forefoot region of the sole structure to a heel region of the sole structure, the first plate including a first surface opposing the upper and a second surface formed on an opposite side of the first plate than the first surface, a second plate extending from the forefoot region of the sole structure to the heel region of the sole structure and including a third surface opposing the second surface of the first plate and a fourth surface disposed on an opposite side of the second plate than the third surface, the third surface being spaced apart from the second surface to define a cavity between the first plate and the second plate that extends from a medial side of the sole structure to a lateral side of the sole structure between the forefoot region and the heel region.

Clause 2: The sole structure of Clause 1, further comprising a first cushion disposed between the first plate and the second plate in the forefoot region.

Clause 3: The sole structure of Clause 2, wherein the first cushion is attached to the second surface of the first plate and is attached to the third surface of the second plate.

Clause 4: The sole structure of Clause 2, wherein the first cushion is a fluid-filled bladder.

Clause 5: The sole structure of Clause 4, further comprising a second cushion disposed between the first plate and the second plate.

Clause 6: The sole structure of Clause 5, wherein the second cushion is disposed between the first cushion and an anterior end of the sole structure.

Clause 7: The sole structure of Clause 5, wherein the second cushion is disposed between the first cushion and a posterior end of the sole structure.

Clause 8: The sole structure of Clause 5, wherein the second cushion is formed from foam.

Clause 9: The sole structure of any one of Clauses 1-8, wherein the fourth surface defines a ground-contacting surface of the sole structure.

Clause 10: The sole structure of any one of Clauses 1-9, further comprising at least one traction element extending from the fourth surface.

Clause 11: A sole structure for an article of footwear including an upper, the sole structure including a first plate extending from a forefoot region of the sole structure to a heel region of the sole structure, the first plate including a first surface opposing the upper and a second surface formed on an opposite side of the first plate than the first surface, a second plate extending from the forefoot region of the sole structure to the heel region of the sole structure and including a third surface opposing the second surface of the first plate and a fourth surface disposed on an opposite side of the second plate than the third surface, the third surface being spaced apart from the second surface to define a cavity between the first plate and the second plate, a first cushion disposed between the first plate and the second plate in the heel region, a second cushion disposed between the first plate and the upper in the forefoot region, the second cushion being different than the first cushion.

Clause 12: The sole structure of Clause 11, wherein the first cushion is one of a fluid-filled bladder and a foam member and the second cushion is the other of the fluid-filled bladder and the foam member.

Clause 13: The sole structure of Clause 11 or 12, wherein the first cushion is attached to the second surface of the first plate and is attached to the third surface of the second plate.

Clause 14: The sole structure of Clause 13, wherein the second cushion is attached to the first surface of the first plate.

Clause 15: The sole structure of any one of Clauses 11-14, wherein the second cushion is attached to the first surface of the first plate.

Clause 16: The sole structure of any one of Clauses 11-15, wherein the first cushion is spaced apart from the second cushion by a gap.

Clause 17: The sole structure of Clause 16, wherein the gap extends through the sole structure from a medial side of the sole structure to a lateral side of the sole structure.

Clause 18: The sole structure of any one of Clauses 11-17, wherein at least one of the first cushion and the second cushion is visible at a medial side of the sole structure and at a lateral side of the sole structure.

Clause 19: The sole structure of any one of Clauses 11-18, wherein the fourth surface defines a ground-contacting surface of the sole structure.

Clause 20: The sole structure of any one of Clauses 11-19, further comprising at least one traction element extending from the fourth surface.

Clause 21: A sole structure for an article of footwear including an upper, the sole structure including a first plate extending from a forefoot region of the sole structure to a heel region of the sole structure, the first plate including a first surface opposing the upper and a second surface formed on an opposite side of the first plate than the first surface, a second plate extending from the forefoot region of the sole structure to the heel region of the sole structure and including a third surface opposing the second surface of the first plate and a fourth surface disposed on an opposite side of the second plate than the third surface, an elongate first fluid-filled bladder disposed between the first plate and the second plate, and an elongate second fluid-filled bladder disposed between the first plate and the second plate.

Clause 22: The sole structure of Clause 21, wherein the elongate first fluid-filled bladder is fluidly isolated from the elongate second fluid-filled bladder.

Clause 23: The sole structure of Clause 21 or 22, wherein the elongate first fluid-filled bladder and the elongate second fluid-filled bladder are attached to the second surface of the first plate and to the third surface of the second plate.

Clause 24: The sole structure of any one of Clauses 21-23, wherein the elongate first fluid-filled bladder is spaced apart from the elongate second fluid-filled bladder in a direction extending between a medial side of the sole structure and a lateral side of the sole structure.

Clause 25: The sole structure of any one of Clauses 21-24, wherein at least one of the elongate first fluid-filled bladder and the elongate second fluid-filled bladder includes a tensile member disposed therein.

Clause 26: The sole structure of any one of Clauses 21-25, wherein at least one of the elongate first fluid-filled bladder and the elongate second fluid-filled bladder is pressurized.

Clause 27: The sole structure of any one of Clauses 21-26, wherein the elongate first fluid-filled bladder and the elongate second fluid-filled bladder are disposed in a forefoot region of the sole structure.

Clause 28: The sole structure of any one of Clauses 21-27, wherein at least one of the elongate first fluid-filled bladder and the elongate second fluid-filled bladder is visible at a medial side of the sole structure and at a lateral side of the sole structure.

Clause 29: The sole structure of any one of Clauses 21-28, wherein the fourth surface defines a ground-contacting surface of the sole structure.

Clause 30: The sole structure of any one of Clauses 21-29, further comprising at least one traction element extending from the fourth surface.

The foregoing description of the embodiments has been provided for purposes of illustration and description. It is not intended to be exhaustive or to limit the disclosure. Individual elements or feature of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear including an upper, the sole structure comprising:

a first plate extending from a forefoot region of the sole structure to a heel region of the sole structure, the first plate including a first surface opposing to the upper and a second surface opposite the first surface, a second plate extending from the forefoot region of the sole structure to the heel region of the sole structure and including a third surface opposing the second surface of the first plate, and a fourth surface opposite than the third surface;

a heel pad extending from a first terminal end disposed in a mid-foot region of the sole structure to a second terminal end disposed in the heel region of the sole structure, such that the first terminal end of the heel pad terminates in the mid-foot region and the heel pad does not extend into the forefoot region, the heel pad connecting the first plate and the second plate in the mid-foot region such that the second plate is supported in the mid-foot region, wherein a portion of the heel pad extends along an outer side surface of the upper;

a first cushion, extending in a direction from the forefoot region to the heel region, wherein a widest part of the first cushion has a first width; and a second cushion extending the direction from the forefoot region to the heel region, wherein a widest part of the second cushion has a second width different than the first width, wherein the first cushion includes a concave side and the second cushion includes a convex side, the concave side of the first cushion facing the convex side of the second cushion, and wherein a gap is defined between the concave side of the first cushion and the convex side of the second cushion.

2. The sole structure of claim 1, wherein the first cushion is disposed between the first plate and the second plate in the forefoot region.

3. The sole structure of claim 2, wherein the first cushion is attached to the second surface of the first plate and is attached to the third surface of the second plate.

4. The sole structure of claim 2, wherein the first cushion is a fluid-filled bladder.

5. The sole structure of claim 4, wherein the second cushion is disposed between the first plate and the second plate.

6. The sole structure of claim 5, wherein the heel pad is disposed between the first cushion and a posterior end of the sole structure.

7. The sole structure of claim 1, wherein the first cushion and the second cushion have an about rectangular shape.

8. The sole structure of claim 1, wherein the first plate has a first thickness in the forefoot region and the first plate has a second thickness in the mid-foot region of the sole structure.

9. The sole structure of claim 1, wherein the third surface is spaced apart from the second surface to define a cavity between the first plate and the second plate which extends from a medial side of the sole structure to a lateral side of the sole structure between the forefoot region and the heel region.

10. A sole structure for an article of footwear including an upper, the sole structure comprising:

a first plate continuously extending from an anterior end at a forward most portion of the sole structure to posterior end at a rearmost portion of the sole structure, the first plate including a first surface opposing the upper and a second surface opposite the first surface;

a second plate extending from a forefoot region of the sole structure to a heel region of the sole structure and including a third surface opposing the second surface of the first plate, and a fourth surface opposite side the third surface, wherein the fourth surface of the second plate is a ground-engaging surface, and wherein the second plate is a rigid plate;

a first cushion extending discontinuously from a medial side of the sole structure to a lateral side of the sole structure, the first cushion comprising:

a first chamber attached to the second surface of the first plate and attached to the third surface of the second plate, wherein the first chamber includes a concave side;

a second cushion chamber attached to the second surface of the first plate and attached to the third surface of the second plate, wherein the second cushion chamber includes a convex side, the concave side of the first chamber and the convex side of the second chamber face one another; and a first gap extending between the concave side and the convex side.

11. The sole structure of claim 10, comprising a second cushion, the second cushion disposed between the first plate and the second plate, and the second cushion disposed anterior to both a first end of the first chamber and a first end of the second chamber, wherein the second cushion is separated from each of the first chamber and the second chamber by a second gap.

12. The sole structure of claim 11, wherein the second plate includes one or more detachable traction elements in the forefoot region and one or more molded traction elements in the heel region, wherein the first chamber is a fluid-filled chamber and the second chamber is a fluid-filled chamber, and wherein a third cushion is foam.

13. The sole structure of claim 10, comprising a third cushion extending from a first end disposed adjacent to a second end of the first chamber and a second end of the second chamber, to the heel region of the sole structure, the third cushion attached to the first plate and the second plate from the first end of a fourth cushion through the heel region of the sole structure.

14. A sole structure for an article of footwear including an upper, the sole structure comprising:

a first plate extending from a forefoot region of the sole structure to a heel region of the sole structure, the first plate including a first surface configured to oppose the upper and a second surface opposite the first surface;

a second plate extending from the forefoot region of the sole structure to the heel region of the sole structure and including a third surface opposing the second surface of the first plate, and a fourth surface opposite than the third surface;

a heel pad extending between a first terminal end that is disposed in a mid-foot region of the sole structure to a second terminal end that is disposed in the heel region of the sole structure, such that the first terminal end of the heel pad does not extend into the forefoot region, the heel pad connecting the first plate and the second plate in the mid-foot region such that the second plate is supported in the mid-foot region;

a first cushion, extending in a direction from the forefoot region to the heel region, wherein a widest part of the first cushion has a first width;

a second cushion extending the direction from the forefoot region to the heel region, wherein a widest part of the second cushion has a second width different than the first width, wherein the first cushion and the second cushion include corresponding concave and convex sides facing one another;

a first gap between the first cushion and the heel pad;

a second gap between the second cushion and the heel pad, wherein the first cushion and the second cushion are located in the forefoot region of the sole structure; and a third gap between the first cushion and the second cushion.

15. The sole structure of claim 14, wherein the first cushion is attached to the second surface of the first plate and to the third surface of the second plate, and the second cushion is attached to the second surface of the first plate and to the third surface of the second plate.

16. The sole structure of claim 14, wherein the third gap is between the concave and convex sides.

17. The sole structure of claim 14, wherein the first cushion is disposed primarily on a medial side of the sole structure, and the second cushion is disposed primarily on a lateral side of the sole structure.

18. The sole structure of claim 14, wherein at least one of the first cushion or the second cushion is a fluid-filled bladder.

19. The sole structure of claim 14, further comprising at least one traction element extending from the second plate.

* * * * *